US010100635B2

(12) United States Patent
Keller et al.

(10) Patent No.: US 10,100,635 B2
(45) Date of Patent: Oct. 16, 2018

(54) WIRED AND WIRELESS DOWNHOLE TELEMETRY USING A LOGGING TOOL

(71) Applicants: Stuart R. Keller, Houston, TX (US); Timothy I. Morrow, Humble, TX (US); James S. Burns, Sugar Land, TX (US); Max Deffenbaugh, Fulshear, TX (US); Mark M. Disko, Glen Gardner, NJ (US); David A. Stiles, Spring, TX (US)

(72) Inventors: Stuart R. Keller, Houston, TX (US); Timothy I. Morrow, Humble, TX (US); James S. Burns, Sugar Land, TX (US); Max Deffenbaugh, Fulshear, TX (US); Mark M. Disko, Glen Gardner, NJ (US); David A. Stiles, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 14/434,733

(22) PCT Filed: Dec. 18, 2013

(86) PCT No.: PCT/US2013/076285
§ 371 (c)(1),
(2) Date: Apr. 9, 2015

(87) PCT Pub. No.: WO2014/100275
PCT Pub. Date: Jun. 26, 2014

(65) Prior Publication Data

US 2015/0292321 A1 Oct. 15, 2015

Related U.S. Application Data

(60) Provisional application No. 61/739,677, filed on Dec. 19, 2012, provisional application No. 61/862,403, filed on Aug. 5, 2013.

(51) Int. Cl.
*G01V 3/00* (2006.01)
*E21B 47/18* (2012.01)
(Continued)

(52) U.S. Cl.
CPC ..... *E21B 47/18* (2013.01); *E21B 47/01* (2013.01); *E21B 47/12* (2013.01); *E21B 47/121* (2013.01); *E21B 47/122* (2013.01)

(58) Field of Classification Search
CPC combination set(s) only.
See application file for complete search history.

(56) References Cited

U.S. PATENT DOCUMENTS 4,314,365 A 2/1982 Peterson et al.
4,773,689 A * 9/1988 Wolters ..... E21B 19/07 294/195

(Continued)

FOREIGN PATENT DOCUMENTS

EP 0 636 763 2/1995
EP 1 409 839 4/2005

(Continued)

OTHER PUBLICATIONS

Emerson Process Management (2011), "Roxar downhole Wireless PT sensor system," www.roxar.com, or downhole@roxar.com, 2 pgs.

*Primary Examiner* — Brian Zimmerman
*Assistant Examiner* — Cal Eustaquio
(74) *Attorney, Agent, or Firm* — ExxonMobil Upstream Research Company—Law Department

(57) ABSTRACT

A system for downhole telemetry is provided herein. The system employs a series of communications nodes spaced along a tubular body in a wellbore. Each communications node is associated with a sensor that senses data indicative of a formation condition or a wellbore parameter along a (Continued)

subsurface formation. The data is stored in memory until a logging tool is run into the wellbore. The data is transmitted from the respective communications nodes to a receiver in the logging tool. The data is then transferred to the surface. A method of transmitting data in a wellbore is also provided herein. The method uses a logging tool to harvest data in a wellbore from a plurality of sensor communications nodes.

42 Claims, 13 Drawing Sheets

(51) Int. Cl.
*E21B 47/12* (2012.01)
*E21B 47/01* (2012.01)

(56) References Cited

U.S. PATENT DOCUMENTS 4,884,071 A 11/1989 Howard
5,128,901 A 7/1992 Drumheller
5,234,055 A 8/1993 Cornette
5,480,201 A 1/1996 Mercer
5,495,230 A 2/1996 Lian
5,562,240 A 10/1996 Campbell
5,592,438 A 1/1997 Rorden et al.
5,850,369 A 12/1998 Rorden et al.
5,924,499 A 7/1999 Birchak et al.
5,995,449 A 11/1999 Green et al.
6,049,508 A 4/2000 Deflandre
6,429,784 B1 8/2002 Beique et al.
6,462,672 B1 10/2002 Besson
6,670,880 B1 12/2003 Hall et al.
6,695,277 B1 2/2004 Gallis
6,717,501 B2 4/2004 Hall et al.
6,816,082 B1 * 11/2004 Laborde ..... E21B 47/12 340/853.2
6,817,633 B2 * 11/2004 Brill ..... F16L 15/001 285/148.19
6,868,037 B2 3/2005 Dasgupta et al.
6,899,178 B2 5/2005 Tubel
6,912,177 B2 6/2005 Smith
6,956,791 B2 10/2005 Dopf et al.
6,980,929 B2 12/2005 Aronstam et al.
6,987,463 B2 1/2006 Beique et al.
7,006,918 B2 2/2006 Economides et al.
7,064,676 B2 6/2006 Hall et al.
7,082,993 B2 8/2006 Ayoub et al.
7,140,434 B2 11/2006 Chouzenoux et al.
7,224,288 B2 5/2007 Hall et al.
7,249,636 B2 7/2007 Ohmer
7,257,050 B2 8/2007 Stewart et al.
7,277,026 B2 10/2007 Hall et al.
7,317,990 B2 1/2008 Sinha et al.
7,348,893 B2 3/2008 Huang et al.
7,411,517 B2 8/2008 Flanagan
7,477,160 B2 1/2009 Lemenager et al.
7,516,792 B2 4/2009 Lonnes et al.
7,595,737 B2 9/2009 Fink et al.
7,602,668 B2 10/2009 Liang et al.
7,649,473 B2 1/2010 Johnson et al.
7,775,279 B2 8/2010 Marya et al.
8,044,821 B2 10/2011 Mehta
8,049,506 B2 11/2011 Lazarev
8,115,651 B2 2/2012 Camwell et al.
8,162,050 B2 4/2012 Roddy et al.
8,220,542 B2 7/2012 Whitsitt et al.
8,237,585 B2 8/2012 Zimmerman
8,242,928 B2 8/2012 Prammer
8,330,617 B2 12/2012 Chen et al.
8,347,982 B2 1/2013 Hannegan et al.
8,381,822 B2 2/2013 Hales et al.
8,434,354 B2 5/2013 Crow et al.
8,496,055 B2 7/2013 Mootoo et al.
8,539,890 B2 9/2013 Tripp et al.
8,544,564 B2 10/2013 Moore et al.
8,826,980 B2 9/2014 Neer
8,833,469 B2 9/2014 Purkis
2002/0026958 A1 3/2002 Brisco
2002/0043369 A1 4/2002 Vinegar et al.
2002/0167418 A1 * 11/2002 Goswami ..... G01V 11/002 340/853.3
2003/0001753 A1 * 1/2003 Cernocky ..... E21B 43/1185 340/853.1
2003/0056953 A1 3/2003 Tumlin et al.
2004/0065443 A1 4/2004 Berg et al.
2004/0073370 A1 4/2004 Dasgupta et al.
2004/0084190 A1 5/2004 Hill et al.
2004/0105342 A1 6/2004 Gardner et al.
2004/0256113 A1 12/2004 LoGiudice et al.
2005/0024231 A1 2/2005 Fincher et al.
2005/0039912 A1 2/2005 Hall et al.
2005/0145010 A1 7/2005 Vanderveen et al.
2005/0284659 A1 12/2005 Hall et al.
2006/0002232 A1 1/2006 Shah et al.
2006/0113089 A1 * 6/2006 Henriksen ..... E21B 34/08 166/386
2006/0115095 A1 6/2006 Giesbrecht et al.
2006/0124310 A1 6/2006 Lopez de Cardenas et al.
2006/0133203 A1 6/2006 James et al.
2006/0143234 A1 * 6/2006 Beeson ..... E21B 47/00
2007/0024464 A1 2/2007 Lemenager et al.
2007/0029112 A1 2/2007 Li et al.
2007/0030762 A1 2/2007 Huang et al.
2007/0139217 A1 6/2007 Beique et al.
2007/0256830 A1 * 11/2007 Entov ..... E21B 43/26 166/250.1
2009/0045974 A1 2/2009 Patel
2009/0159272 A1 6/2009 Auzerias et al.
2009/0264956 A1 10/2009 Rise et al.
2009/0277688 A1 11/2009 Oothoudt
2009/0289808 A1 11/2009 Prammer
2010/0013663 A1 1/2010 Cavender et al.
2010/0126718 A1 5/2010 Lilley
2010/0157739 A1 6/2010 Slocum et al.
2010/0176813 A1 7/2010 Simon
2010/0194584 A1 8/2010 Savage
2011/0066378 A1 3/2011 Lerche et al.
2011/0168403 A1 7/2011 Patel
2011/0186290 A1 8/2011 Roddy et al.
2011/0192596 A1 * 8/2011 Patel ..... E21B 17/028 166/250.11
2011/0275313 A1 11/2011 Baldemair et al.
2011/0280294 A1 11/2011 Luo et al.
2011/0297376 A1 * 12/2011 Holderman ..... E21B 17/1035 166/278
2012/0017673 A1 1/2012 Godager
2012/0024050 A1 2/2012 Godagar
2012/0024052 A1 2/2012 Eriksen
2012/0043079 A1 2/2012 Wassouf et al.
2012/0090687 A1 4/2012 Grisby et al.
2012/0170410 A1 7/2012 Hay
2012/0241172 A1 9/2012 Ludwig et al.
2012/0256415 A1 * 10/2012 Dole ..... F16L 17/04 285/337
2012/0256492 A1 10/2012 Song et al.
2012/0257475 A1 10/2012 Luscombe et al.
2013/0008648 A1 1/2013 Lovorn et al.
2013/0106615 A1 5/2013 Prammer
2013/0110402 A1 5/2013 Godager
2013/0175094 A1 7/2013 Ross et al.
2013/0248172 A1 9/2013 Angeles Boza et al.
2013/0248174 A1 9/2013 Dale et al.
2014/0152659 A1 6/2014 Davidson et al.
2014/0266769 A1 9/2014 van Zelm
2014/0327552 A1 11/2014 Filas et al.
2014/0352955 A1 12/2014 Tubel et al.
2015/0003202 A1 1/2015 Palmer et al.

(56) References Cited

U.S. PATENT DOCUMENTS

| | | | |
|---|---|---|---|
| 2015/0009040 | A1 | 1/2015 | Bowles et al. |
| 2015/0027687 | A1 | 1/2015 | Tubel |

FOREIGN PATENT DOCUMENTS

| | | | |
|---|---|---|---|
| WO | WO 2010/074766 | | 7/2010 |
| WO | WO 2013/079928 | | 6/2013 |
| WO | WO 2013/079929 | | 6/2013 |
| WO | WO 2013/112273 | A2 | 8/2013 |
| WO | WO 2014/018010 | A1 | 1/2014 |
| WO | WO 2014/049360 | A2 | 4/2014 |
| WO | WO 2014/134741 | A1 | 9/2014 |

* cited by examiner

WIRED AND WIRELESS DOWNHOLE TELEMETRY USING A LOGGING TOOL

CROSS-REFERENCE TO RELATED APPLICATIONS

This application is the National Stage of International Application No. PCT/US2013/076285, filed Dec. 18, 2013, which claims benefit of U.S. Provisional Patent Application No. 61/739,677, filed Dec. 19, 2012, and U.S. Provisional Patent Application No. 61/862,403, filed Aug. 5, 2013, both are incorporated by reference herein in their entirety.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present invention relates to the field of data transmission. More specifically, the invention relates to the transmission of data along pipes within a wellbore. The present invention further relates to the capturing of wireless data in a wellbore from novel downhole communications nodes using a logging tool.

General Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations. A cementing operation is typically conducted in order to fill the annular area with cement. The combination of cement and casing strengthens the wellbore and facilitates the isolation of formations behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place. This is a tubular body that resides adjacent one or more producing reservoirs, or "pay zones." The production casing is frequently in the form of a liner, that is, a tubular body that is not tied to the surface, but is hung from a next lowest string of casing using a liner hanger. In either instance, the production casing is perforated to provide fluid communication between the reservoir and the production tubing.

In some instances, the wellbore is left uncased along the pay zones. This means that no liner string is used. This is known as an open hole completion. To support the open wellbore and to prevent the migration of sand and fines into the wellbore, a filtering screen is typically placed along the subsurface reservoirs. A column of sand may also be installed around the filtering screen, thereby forming a gravel pack.

In order to move production fluids to the surface, a string of tubing is run into the casing. A packer is set proximate a lower end of the tubing to seal an annular area formed between the tubing and the surrounding strings of casing. The tubing then becomes a string of production pipe through which hydrocarbon fluids may be lifted from the pay zones.

As part of the completion process, a wellhead is installed at the surface. The wellhead controls the flow of production fluids to the surface, or the injection of fluids into the wellbore. Fluid gathering and processing equipment such as pipes, valves and separators are also provided. Production operations may then commence.

It is desirable to obtain data from the wellbore after completion. In the oil and gas industry, cables and wires are routinely run into wells for observation and analysis. These may include slick lines or wire lines for formation logging operations. Such may also include the use of fixed cables for gathering data from downhole sensors.

Various wireless technologies have also been proposed or developed for downhole communications. Such technologies are referred to in the industry as telemetry.

One example of telemetry is mud pressure pulse transmission, or so-called mud pulse telemetry. Mud pulse telemetry is commonly used during drilling to obtain real time data from sensors at or near the drill bit. Mud pulse telemetry employs variations in pressure in the drilling mud to transmit signals from a bottom hole assembly up to the surface. The variations in pressure caused by mechanical pulses may be sensed and analyzed by a computer at the surface.

Another example of downhole telemetry involves the use of acoustic energy. Acoustic telemetry employs an acoustic signal generated at or near the bottom of a well, such as from a bottom hole assembly during drilling. The signal is transmitted through steel pipe in the wellbore, meaning that the pipe serves as the carrier medium for sound waves. Transmitted sound waves are detected and converted to electrical signals at the surface for analysis.

U.S. Pat. No. 5,924,499 entitled "Acoustic Data Link and Formation Property Sensor for Downhole MWD System," teaches the use of acoustic signals for "short hopping" a component along a drill string. Signals are transmitted from a drill bit or from a near-bit sub and across the mud motors. This may be done by sending separate acoustic signals simultaneously—one that is sent through the drill string, a second that is sent through the drilling mud, and optionally, a third that is sent through the formation. These signals are then processed to extract readable signals.

U.S. Pat. No. 6,912,177, entitled "Transmission of Data in Boreholes," addresses the use of an acoustic transmitter that is as part of a downhole tool. Here, the transmitter is provided adjacent a downhole obstruction such as a shut-in valve along a drill stem so that a signal may be sent across the drill stem. U.S. Pat. No. 6,899,178, entitled "Method and System for Wireless Communications for Downhole Applications," describes the use of a "wireless tool transceiver" that utilizes acoustic signaling. Here, an acoustic transceiver is in a dedicated tubular body that is integral with a gauge and/or sensor. This is described as part of a well completion.

Another telemetry system that has been suggested involves electromagnetic (EM) telemetry. EM telemetry employs electromagnetic waves, or alternating current magnetic fields, to "jump" across pipe joints. In practice, a specially-milled drill pipe is provided that has a conductor wire machined along an inner diameter. The conductor wire transmits signals to an induction coil at the end of the pipe. The induction coil, in turn, then transmits an EM signal to another induction coil, which sends that signal through the conductor wire in the next pipe. Thus, each threaded connection provides a pair of specially milled pipe ends for EM communication.

For example, service company National Oilwell Varco® of Houston, Tex. offers a drill pipe network, referred to as IntelliServ® that uses EM telemetry. The IntelliServ® system employs drill pipe having integral wires that can transmit LWD/MWD data to the surface at speeds of up to 1 Mbps. This creates a communications system from the drill string itself. The NOV® IntelliServ® communications system uses an induction coil built into both the threaded box and pin ends of each drill pipe so that data may be transmitted across each connection. Examples of IntelliServe® patents are U.S. Pat. No. 7,277,026 entitled "Downhole Component With Multiple Transmission Elements," and U.S. Pat. No. 6,670,880 entitled "Downhole Data Transmission System." It is observed that the induction coils in an EM telemetry system must be precisely located in the box and pin ends of the joints of the drill string to ensure reliable data transfer.

Recently, the use of radiofrequency signals has been suggested. This is offered in U.S. Pat. No. 8,242,928 entitled "Reliable Downhole Data Transmission System." This patent suggests the use of electrodes placed in the pin and box ends of pipe joints. The electrodes are tuned to receive RF signals that are transmitted along the pipe joints having a conductor material placed there along, with the conductor material being protected by a special insulating coating. While high data transmission rates can be accomplished using RF signals in a downhole environment, the transmission range is typically limited to a few meters. This, in turn, requires the use of numerous repeaters.

A need exists for a high speed data transmission system in a wellbore that does not require the machining of induction coils with precise grooves placed into pipe ends or the need for electrodes in the pipe ends. Further, a need exists for such a transmission system that does not require the precise alignment of induction coils or the placement of RF electrodes between pipe joints. In addition, a need exists for a hybrid wired-and-wireless transmission system that allows for the transmission of data from a formation, wherein the data may ultimately be wirelessly captured by running a logging tool into the wellbore.

SUMMARY OF THE INVENTION

A downhole acoustic telemetry system is first provided herein. The system employs novel communications nodes spaced along pipe joints within a wellbore. The pipe joints may be, for example, joints of casing (including a liner), joints of production tubing, or joints of sand control screen.

The system first comprises one or more downhole sensors. In one aspect, each of the one or more sensors resides along the wellbore proximate a subsurface formation. The subsurface formation preferably contains hydrocarbon fluids in commercially viable quantities. Each of the downhole sensors is configured to sense a subsurface condition, and then send a signal indicative of that subsurface condition.

In one aspect, the subsurface condition is pressure. In that instance, the sensor is a pressure sensor. In another aspect, the subsurface condition is temperature. In that instance, the sensor is a temperature sensor. Other types of sensors may be used. These include induction logs, gamma ray logs, formation density sensors, sonic velocity sensors, vibration sensors, resistivity sensors, flow meters, microphones, geophones, strain gauges, or combinations thereof.

The system also includes one or more sensor communications nodes, or two or more sensor communications nodes, or in some embodiments there may only be a sensor communications node for every other joint. The exact number and arrangement may depend upon factors such as signal strength, signal quality, and joint length. The one or more sensor communications nodes also reside along the wellbore proximate a depth of the subsurface formation. Each of the sensor communications nodes has a housing. The housing is fabricated from a steel material. In one aspect, each of the communications nodes also has a sealed bore formed within the housing.

In one embodiment, the sensor communications nodes are independently powered. Thus, an independent power source such as a battery or a fuel cell is provided within the bore of those housings for providing power to the transceivers. In another aspect, particularly when the sensor communications nodes are placed along an outer diameter of production tubing, the sensor communications nodes may be powered by a wire extending from the surface.

Each of the one or more downhole sensors resides within the housing of a corresponding sensor communications node. Alternatively, each of the downhole sensors resides adjacent the housing of a corresponding sensor communications node.

In one aspect, each of the sensor communications nodes includes one, and preferably two, clamps. In this way, each of the sensor communications nodes is clamped onto an outer surface of a subsurface pipe, such as casing. The sensor communications nodes may be placed along 2, 10, or even 20 or more joints of casing or sand control screen, with one node per joint.

Each of the sensor communications nodes has a transmitter. The transmitter resides within the sealed bore. The transmitter transmits wireless signals indicative of the subsurface condition as reported by the downhole sensors.

The system also includes a logging tool. The logging tool comprises a receiver. The receiver is configured to harvest the wireless signals from the transmitters when the logging tool is run into (or retrieved back from) a wellbore.

The system further includes a working line. The working line is configured to run the logging tool into a wellbore proximate an end of the working line.

In one aspect, the logging tool further comprises a memory. The memory is configured to store the harvested data in the logging tool until the logging tool is retrieved back to the surface. In another aspect, the working line comprises an insulated electric cable or a fiber optic cable. In this instance, the harvested data is transmitted back to the surface in real time.

For a land-based operation, the surface is an earth surface, preferably at or near the well head. For an offshore operation, the surface may be a production platform, a drilling rig, a floating ship-shaped vessel, or an FPSO.

In one aspect, the wellbore is completed using a production casing that has been perforated, or using a slotted liner. In this instance, a plurality of sensor communications nodes may be connected to an inner diameter or an outer diameter of the production casing or the slotted liner. In another aspect, the wellbore is completed as an open hole. In this instance, a plurality of sensor communications nodes may be connected to an inner or outer diameter of sand control screen joints. In still another embodiment, one or more sensor communications nodes are also embedded into or placed immediate along a rock matrix making up the subsurface formation.

The wellbore may include a production tubing. The tubing extends from the surface and down proximate the subsurface formation. In this instance, one or more sensor communications nodes may optimally be placed along an outer diameter of the production tubing.

The system may optionally include a wellbore cable. The wellbore cable may be used to deliver power to certain of the sensor communications nodes, particularly when sensor communications nodes reside along the production tubing.

In one embodiment, the downhole acoustic telemetry system also comprises a series of acoustic communications nodes. These are in addition to the sensor communications nodes. Each of the acoustic communications nodes is attached to a joint of subsurface pipe within the wellbore according to a pre-designated spacing. Further, adjacent acoustic communications nodes are configured to communicate by acoustic signals transmitted up through the joints of pipe. Preferably, the joints of pipe form a section of production casing.

Each of the acoustic communications nodes comprises:

a housing having a sealed bore;

an electro-acoustic transducer and associated transceiver residing within the housing configured to relay signals, with each signal representing a packet of information that comprises an identifier for the acoustic communications node originally transmitting the signal, and an acoustic waveform indicative of a subsurface condition; and an independent power source also residing within the housing for providing power to the transceiver, and with the housing being fabricated from a material having a resonance frequency that is within the frequency band used for the acoustic signals;

Each of the acoustic communications nodes is configured to acoustically transmit signals originating from a sensor communications node. Those signals are then transmitted, node to node, up the wellbore, using the subsurface pipe as a carrier medium. The signals are carried up to a last acoustic communications node. The last acoustic communications node includes a transmitter that transmits signals to the receiver on the logging tool. In this arrangement, the data harvested from the last acoustic communications nodes comprises multi-plexed data generated from one or more sensor communications nodes to the acoustic communications nodes.

In one embodiment, at least one of the one or more sensor communications nodes resides within or is in contact with a rock matrix making up the surface formation. Alternatively, at least one of the sensor communications nodes resides along a downhole tool. The downhole tool may be, for example, a sliding sleeve or an inflow control device.

A separate method of transmitting data along a wellbore and up to a surface is also provided herein. The method uses a plurality of data transmission nodes situated along a tubular body to accomplish a wireless transmission of data along the wellbore. The wellbore penetrates into a subsurface formation, allowing for the communication of a wellbore condition at the level of the subsurface formation up to the surface.

The method first includes placing one or more downhole sensors along the wellbore. The sensors are placed proximate a depth of the subsurface formation. In one aspect, the sensors reside within the housing of a respective sensor communications node, such as the sensor communications nodes described above. Alternatively, each of the downhole sensors resides adjacent the housing of a corresponding sensor communications node.

The method also includes generating signals at the downhole sensors that are indicative of one or more subsurface conditions.

The method further includes providing one or more sensor communications nodes along the wellbore. Each sensor communications node is configured to process signals generated by a downhole sensor, and transmit those signals via a transmitter.

The method additionally includes running a logging tool into the wellbore. The logging tool is run proximate the end of a working line. The logging tool includes a receiver. The receiver is configured to harvest data from the transmitters of the sensor communications nodes.

The method also includes harvesting data from one or more of the sensor communications nodes from the transmitter. The method then includes receiving the harvested data at the surface. For a land-based operation, the surface is an earth surface, preferably at or near the well head. For an offshore operation, the surface may be a production platform, a drilling rig, a floating ship-shaped vessel, or an FPSO.

In one embodiment, receiving the harvested data comprises transmitting the harvested data from the logging tool up a communications wire in the running tool and to a processor at the surface. In this instance, the communications wire may be an insulated electrical cable or a fiber optic cable. In another embodiment, receiving the harvested data comprises storing the harvested data in memory on the logging tool, pulling the running tool from the wellbore, retrieving the logging tool, and then uploading the harvested data onto a processor at the surface.

The one or more sensor communications nodes may reside on either an inner diameter or an outer diameter of a string of production casing. Alternatively or in addition, each of the sensor communications nodes reside on an outer diameter of a joint of production tubing. Alternatively or in addition, each of the one or more sensor communications nodes resides on either an inner diameter or an outer diameter of joints of sand control screen, such as along the base pipe of sand control screen joints.

In one embodiment, the method further comprises running joints of steel pipe into the wellbore. The joints of pipe are connected by threaded couplings to form a pipe string. The method then includes attaching a series of acoustic communications nodes to the joints of pipe during run-in. The acoustic communications nodes are placed according to a pre-designated spacing. Adjacent acoustic communications nodes are configured to communicate by acoustic signals transmitted through the joints of pipe. The acoustic communications nodes are constructed in accordance with the acoustic communications nodes described above. The method then includes sending acoustic signals from the acoustic communications nodes, node-to-node, to a last acoustic communications node.

In this arrangement, each of the acoustic communications nodes is configured to acoustically transmit signals originating from a sensor communications node. Those signals are then transmitted, node to node, up the wellbore, using the subsurface pipe as a carrier medium. The signals are carried up to a last acoustic communications node. The last acoustic communications node includes a transmitter that transmits signals to the receiver on the logging tool. The data harvested from the last acoustic communications nodes comprises multi-plexed data generated from two or more sensor communications nodes to the acoustic communications nodes. Because data is harvested from the last acoustic communications node, that last communications node may also be considered a sensor communications node.

In either embodiment, the method may further comprise transmitting energy from the logging tool to the sensor communications nodes to re-charge a battery within the sensor communications nodes.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

In FIG. 8A, the leading edge, or front, of the shoe is seen. In FIG. 8B, the back of the shoe is seen.

DETAILED DESCRIPTION OF CERTAIN EMBODIMENTS

Definitions

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions. Hydrocarbon fluids may include, for example, oil, natural gas, gas condensates, coal bed methane, shale oil, shale gas, and other hydrocarbons that are in a gaseous or liquid state.

As used herein, the term "subsurface" refers to geologic strata occurring below the earth's surface.

As used herein, the term "sensor" includes any electrical sensing device or gauge. The sensor may be capable of monitoring or detecting pressure, temperature, fluid flow, vibration, resistivity, sound, vibrations, or other formation data.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refer to a portion of a subsurface formation containing hydrocarbons. The term "hydrocarbon-bearing formation" may alternatively be used.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "tubular member," "tubular body" or "subsurface pipe" refer to any pipe, such as a joint of casing, a portion of a liner, a production tubing, an injection tubing, a pup joint, underwater piping, or a base pipe in a sand control screen.

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Figure 1:
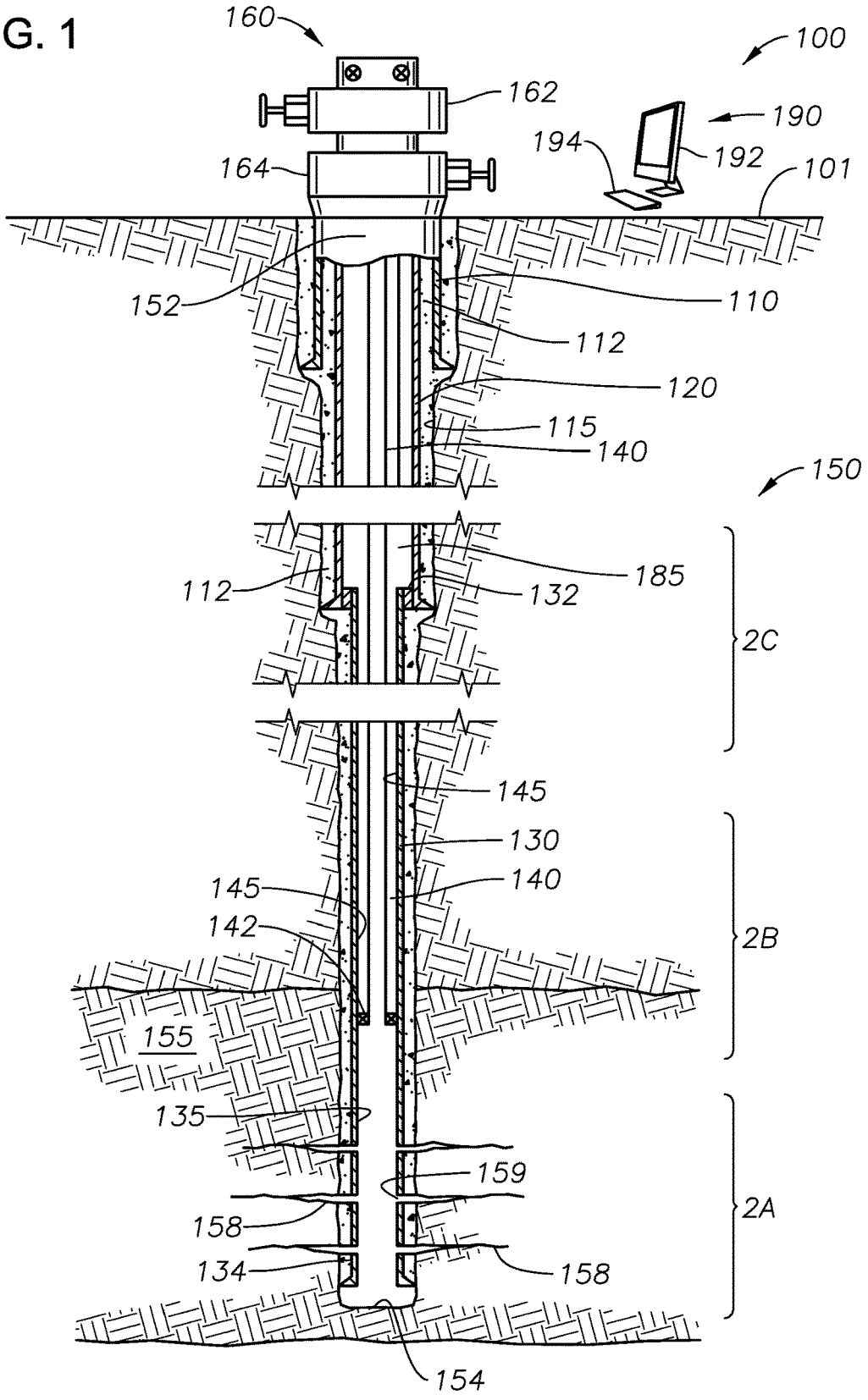
FIG. 1 is a side, cross-sectional view of an illustrative wellbore. The wellbore has been completed as a cased hole completion. A string of production tubing is in place within the wellbore.

FIG. 1 is a side, cross-sectional view of an illustrative well site 100. The well site 100 includes a wellbore 150 that penetrates into a subsurface formation 155. The wellbore 150 has been completed as a cased-hole completion for producing hydrocarbon fluids.

The well site 100 includes a well head 160. The well head 160 is positioned at an earth surface 101 over the wellbore 150. The well head 160 controls and directs the flow of formation fluids from the subsurface formation 155 to the surface 101.

The well head 160 may be any arrangement of pipes or valves that receives reservoir fluids at the top of the well. In the arrangement of FIG. 1, the well head 160 is a so-called Christmas tree. A Christmas tree is typically used when the subsurface formation 155 has enough in situ pressure to drive production fluids from the formation 155, up the wellbore 150, and to the surface 101. The illustrative well head 160 includes a top valve 162 and a bottom valve 164. In some contexts, these valves are referred to as "master valves."

It is understood that rather than using a Christmas tree, the well head 160 may alternatively include a motor (or prime mover) at the surface 101 that drives a pump. The pump, in turn, reciprocates a set of sucker rods and a connected positive displacement pump (not shown) downhole. The pump may be, for example, a rocking beam unit or a hydraulic piston pumping unit. Alternatively still, the well head 160 may be configured to support a string of production tubing having a downhole electric submersible pump, a gas lift valve, or other means of artificial lift (not shown). The present inventions are not limited by the configuration of pumping equipment unless expressly noted in the claims.

Referring now to the wellbore 150, the wellbore 150 has been completed with a series of pipe strings, referred to as casing. First, a string of surface casing 110 has been cemented into the formation. Cement is shown in an annular space 115 within the wellbore 150 surrounding the casing 110. The surface casing 110 has an upper end 152 in sealed connection with the lower valve 164.

Next, at least one intermediate string of casing 120 is cemented into the wellbore 150. The intermediate string of casing 120 is in sealed fluid communication with the upper master valve 162. Cement is again shown in an annular space 115 of the wellbore 150. The combination of the casing strings 110, 120 and the cement sheath in the annulus 115 strengthens the wellbore 150 and facilitates the isolation of formations behind the casing 110, 120.

It is understood that a wellbore 150 may, and typically will, include more than one string of intermediate casing. Some of the intermediate casing strings may be only partially cemented into place, depending on regulatory requirements and the presence of migratory fluids in any adjacent strata. In some instances, an intermediate string of casing may be a liner.

Finally, a production string 130 is provided. The production string 130 is hung from the intermediate casing string 120 using a liner hanger 132. The production string 130 is a liner that is not tied back to the surface 101. A substantial portion of the production liner 130 is preferably cemented in place.

The production liner 130 has a lower end 134 that extends substantially to an end 154 of the wellbore 150. For this reason, the wellbore 150 is said to be completed as a cased-hole well. In one aspect, the production string 130 is not a liner but is a casing string that extends back to the surface 101.

In order to create fluid communication between a bore 135 of the liner 130 and the surrounding rock matrix making up the subsurface formation 155, the liner 130 has been perforated. Perforations are seen at 159. In the view of FIG. 1, one set of perforations 159 is provided. However, it is understood that additional sets of perforations may be provided in separate zones. Those zones, in turn, may be isolated through the use of downhole tools such as packers and sliding sleeves (not shown).

To enhance the exposure of the rock formation 155 to the pipe bore 135, the operator will fracture the formation 155. This is done by injecting a fracturing fluid under high pressure through the perforations 159 and into the formation 155. The fracturing process creates fractures 158 into the subsurface formation 155.

The wellbore 150 also includes a string of production tubing 140. The production tubing 140 extends from the well head 160 down to the subsurface formation 155. In the arrangement of FIG. 1, the production tubing 140 terminates proximate an upper end of the subsurface formation 155. A production packer 142 is provided at a lower end of the production tubing 140 to seal off an annular region 145 between the tubing 140 and the surrounding production liner 130. However, the production tubing 140 may optionally extend closer to the end 134 of the liner 130.

The production tubing 140 is made up of a series of pipe joints. The joints are typically 30 to 40 feet in length. The pipe joints are typically threadably coupled and then lowered into the wellbore 150 during completion, drilling, or production operations.

It is desirable to monitor subsurface conditions below the level of the production tubing 140. To accomplish this, a series of novel communications nodes is provided herein. The communications nodes are referred to as sensor communications nodes and acoustic communications nodes. The nodes are not visible in FIG. 1; however, nodes are indicated at 170 and 175 in FIGS. 2A through 2C.

Figure 2B:
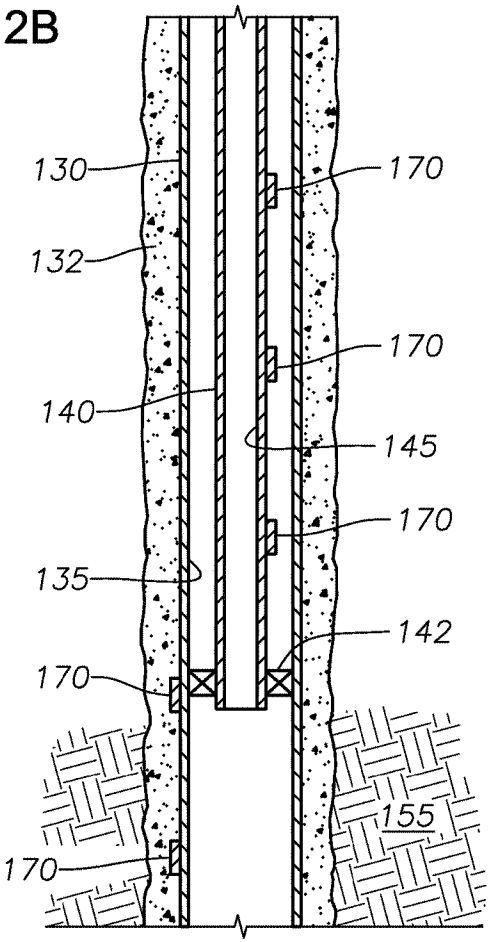
FIG. 2B is an enlarged side, cross-sectional view of a portion of the wellbore of FIG. 1. Here, portion 2B from the wellbore of FIG. 1 is shown. Communications nodes are shown along both the production casing and the production tubing.
Figure 2A:
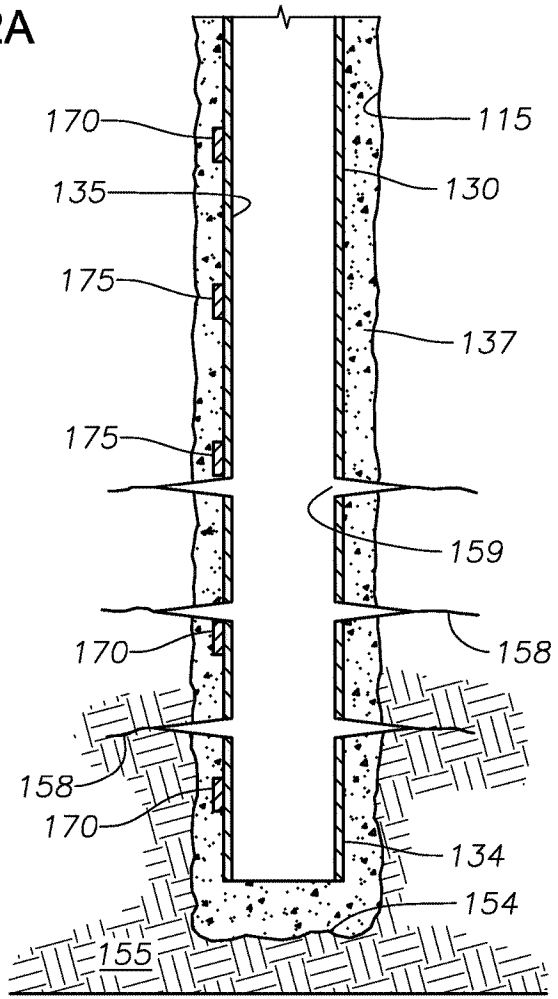
FIG. 2A is an enlarged side, cross-sectional view of a portion of the wellbore of FIG. 1. Here, portion 2A from the wellbore of FIG. 1 is shown. Communications nodes are shown along the production casing.

FIG. 2A is an enlarged side, cross-sectional view of a portion of the wellbore 150 of FIG. 1. Here, a portion 2A of the wellbore 150 is shown. Portion 2A is taken along the production casing 130. Perforations 159 are seen. The perforations 159 extend through the casing 130, through a cement matrix 137 in the annulus 115, and into the formation 155.

FIG. 2A also shows a series of communications nodes. The two lowermost communications nodes are shown at 175. These are referred to as sensor communications nodes. The sensor communications nodes 175 are shown affixed to an outer diameter of the production casing 130. However, it is understood that the nodes 175 may alternatively be placed on an inner diameter of the production casing 130.

Each sensor communications node 170 preferably comprises a housing having a sealed bore. Each sensor communications node 170 also has an associated sensor and a transmitter. These components are not visible in the view of FIG. 2A. However, FIG. 5 offers an enlarged view of a joint of pipe 500 and a communications node 550. The illustrative communications node 550 is shown exploded away from the pipe joint 500 for clarity.

The illustrated pipe joint 500 is intended to represent a joint of wellbore production tubing 130, but the technology is also applicable to other tubulars, such as well casing, pipeline joints, and drill pipe. The pipe joint 500 has an elongated wall 510 defining an internal bore 515. The bore 515 transmits hydrocarbon fluids during an oil and gas production operation. The pipe joint 500 illustrates a box end 522 having internal threads such as may be provided by an integrated box end or by using an internally threaded collar as illustrated. The pipe joint 500 also includes a pin end 524 having external threads. The communications node 550 resides intermediate the box end 522 and the pin end 524.

Figure 5:
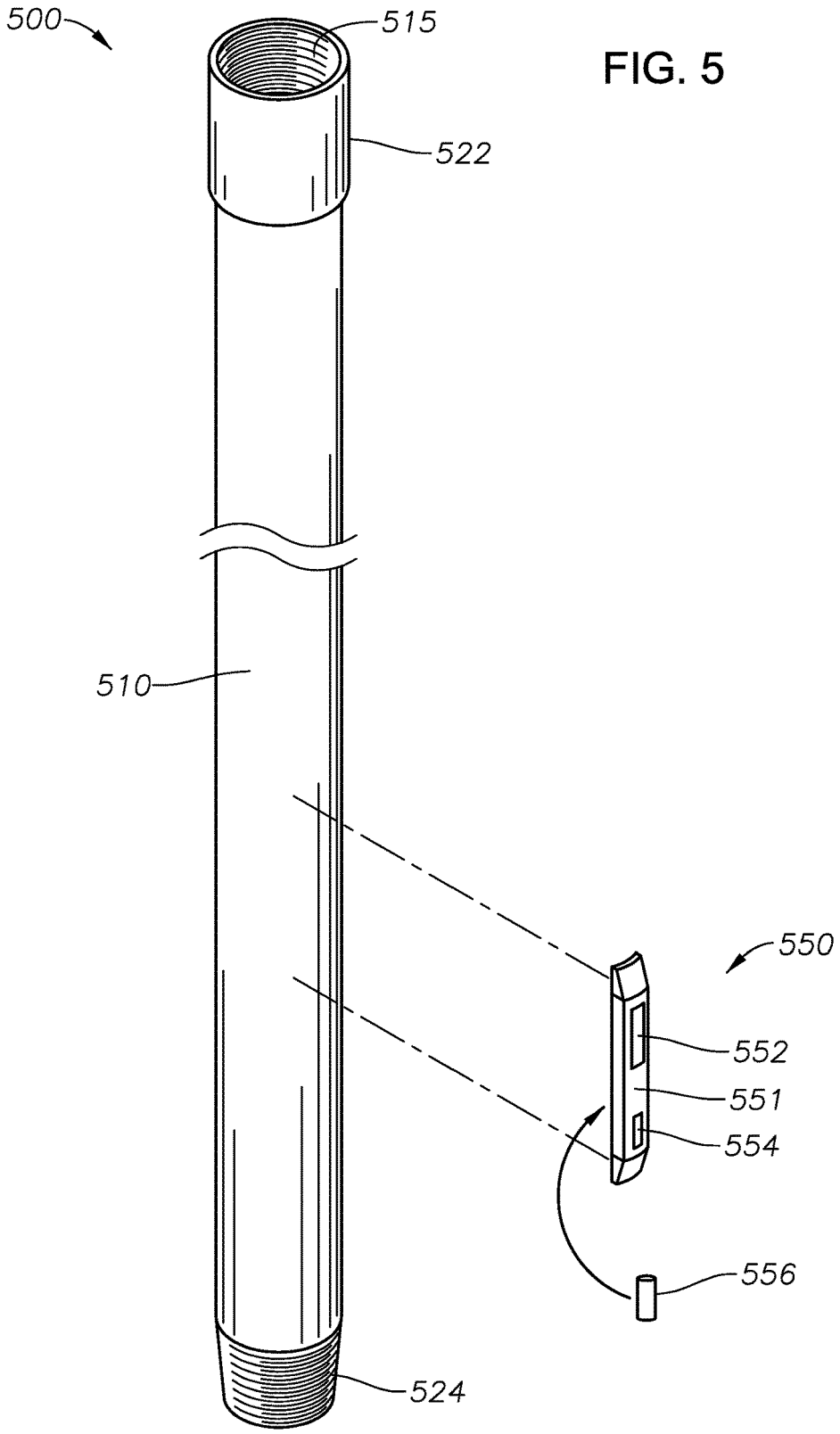
FIG. 5 is a perspective view of an illustrative pipe joint. A sensor communications node is shown exploded away from the pipe joint.

The communications node 550 shown in FIG. 5 is designed to be pre-welded onto the wall 510 of the pipe joint 500. Alternatively, the communications node 550 may be glued to the wall 510 using an adhesive such as epoxy. However, it is preferred that the communications node 550 be configured to be selectively attachable to/detachable from a pipe joint 500 by mechanical means at the well site 100. This may be done, for example, through the use of clamps. Such a clamping system is shown at 1000 in FIG. 10, described more fully below. In any instance, the communications node 550 offers an independent communications device that is designed to be attached to a surface of a well pipe 500.

In FIG. 5, the communications node 550 includes an elongated body 551. The body 551 supports a sensor, shown schematically at 552. The body 551 also supports a transmitter, shown schematically at 554. The transmitter 554 receives electrical signals from the sensor 552, holds the signals in memory, and then transmits a wireless signal to a logging tool (shown at 900 in FIG. 9) when the logging tool is run into the bore 515 of the pipe 500. The transmitted signal is indicative of a subsurface condition as measured or detected by the sensor 552 over time.

It is preferred that the communications node 550 also be independently-powered. To this end, the communications node 550 may have batteries 556. In one aspect, the batteries 556 are re-charged when the logging tool is passed through the bore 515 and across the communications node 550. This is beneficial as the useful life of a battery is limited, and is dependent on such factors as downhole temperature and energy demand from the node electronics.

Battery re-charging preferably takes place through electrical current induction. Electrical current induction is sometimes known as "inductive charging" or "wireless charging." Inductive charging uses an electromagnetic field to transfer energy between two objects. Induction chargers typically use a first induction coil to create an alternating electromagnetic field from within a charging base station. The electromagnetic field is sensed by a second induction coil associated with an electrical device or battery.

In practice, energy is sent through an inductive coupling from the logging tool 900 to an electrical device within the communications node 550. The electrical device takes advantage of the created magnetic energy to charge the batteries 556. Thus, the second induction coil in the communications node 550 takes power from the electromagnetic field and converts it into an electrical current that charges the batteries 556.

Other techniques may be used or developed for wirelessly re-charging the node batteries. These may include the use of mechanical vibration, or acoustic energy, for generating electrical current, or the use of heat or chemical means. In any instance, the communications node 550 offers an independently-powered device that is designed to quickly be attached to an external surface of a well pipe 500.

Returning to FIG. 2A, additional communications nodes are also shown. These are noted at 175, and may be referred to as acoustic communications nodes. The acoustic communications nodes 175 are shown spaced along the production casing 130.

The acoustic communications nodes 175 are configured generally in accordance with the sensor communications nodes 170 described above and as shown at 500. However, the acoustic communications nodes 175 do not include sensors (such as sensor 552 of FIG. 5), but are designed to receive data from and transmit data to adjacent acoustic communications nodes 175 using acoustic transceivers. In this way, acoustic signals indicative of a subsurface condition from a sensor 552 are sent node-to-node up to a last acoustic communications node. That last acoustic communications node is not shown in FIG. 2A, but is technically another sensor communications node 170 as it stores the acoustically-generated signals in its memory until those signals are transmitted to the logging tool 900 using a transmitter 554.

In operation, each sensor communications node 170 is in electrical communication with a sensor 552. This may be by means of a short wire, or by means of wireless communication such as infrared or radio-frequency communication. The sensor communications nodes 170 are configured to receive signals from the sensors 552, wherein the signals represent a subsurface condition. The subsurface condition may be pressure. A pressure sensor may be, for example, a sapphire gauge or a quartz gauge. Sapphire gauges are preferred as they are considered more rugged for the high-temperature downhole environment. Alternatively, the sensors may be temperature sensors. Alternatively, the sensors may be microphones for detecting ambient noise, or geophones (such as a tri-axial geophone) for detecting the presence of micro-seismic activity. Alternatively still, the sensors may be fluid flow measurement devices such as a spinners, or fluid composition sensors, or formation sensors. The sensors may alternatively be strain gauges.

Figure 6A:
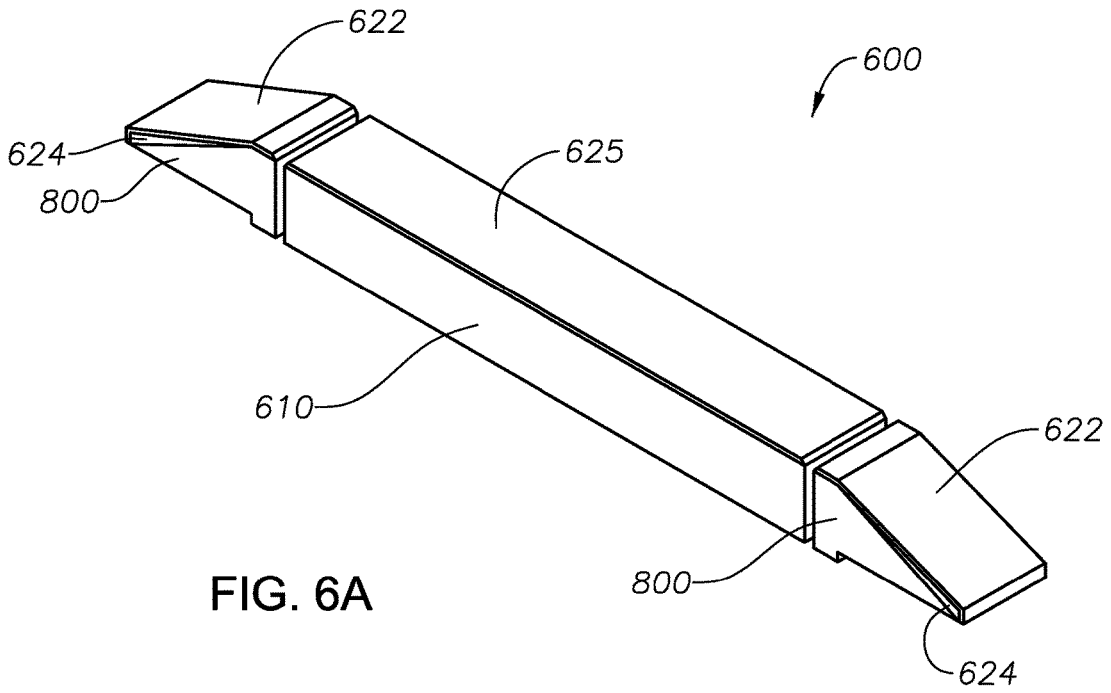
FIG. 6A is a perspective view of a subsurface communications node as may be used in the data transmission systems of the present invention, in one embodiment.

FIG. 6A is a more detailed perspective view of a sensor communications node 600 as may be used in the wellbore of FIG. 2A, in one embodiment. The sensor communications node 600 is uniquely designed to provide acoustic communication using a transceiver within a novel downhole housing assembly. This is beneficial when the operator desires to send wireless signals from a sensor communications node partially up the wellbore.

Figure 6B:
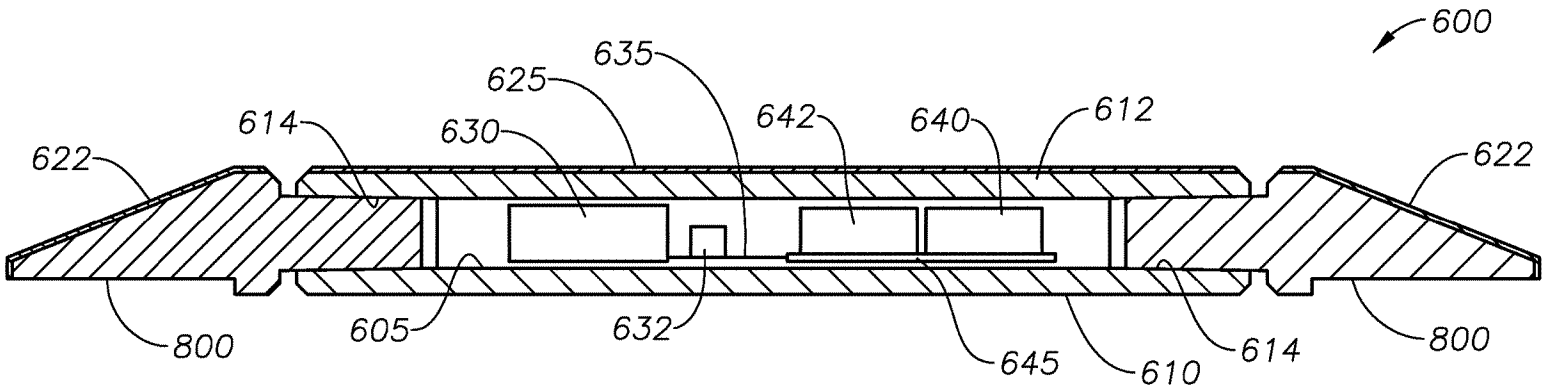
FIG. 6B is a cross-sectional view of the communications node of FIG. 6A. The view is taken along the longitudinal axis of the node. Here, a sensor is provided within the communications node.

FIG. 6B is a cross-sectional view of the communications node 600 of FIG. 6A. The view is taken along the longitudinal axis of the node 600. The sensor communications node 600 will be discussed with reference to FIGS. 6A and 6B, together.

The communications node 600 first includes a housing 610. The housing 610 is designed to be attached to an outer wall of a joint of wellbore pipe, such as the pipe joint 500 of FIG. 5. Where the wellbore pipe is a carbon steel pipe joint such as drill pipe, casing or liner, the housing is preferably fabricated from carbon steel. This metallurgical match avoids galvanic corrosion at the coupling.

The housing 610 is dimensioned to be strong enough to protect internal electronics. In one aspect, the housing 610 has an outer wall 612 that is about 0.2 inches (0.51 cm) in thickness. A bore 605 is formed within the wall 612. The bore 605 houses the electronics, shown in FIG. 6B as a battery 630, a power supply wire 635, a transceiver 640, and a circuit board 645. The circuit board 645 will preferably include a micro-processor or electronics module that processes acoustic signals. An electro-acoustic transducer 642 is provided to convert acoustical energy to electrical energy (or vice-versa) and is coupled with outer wall 612 on the side attached to the tubular body. The transducer 642 is in electrical communication with a sensor 632.

Figure 6C:
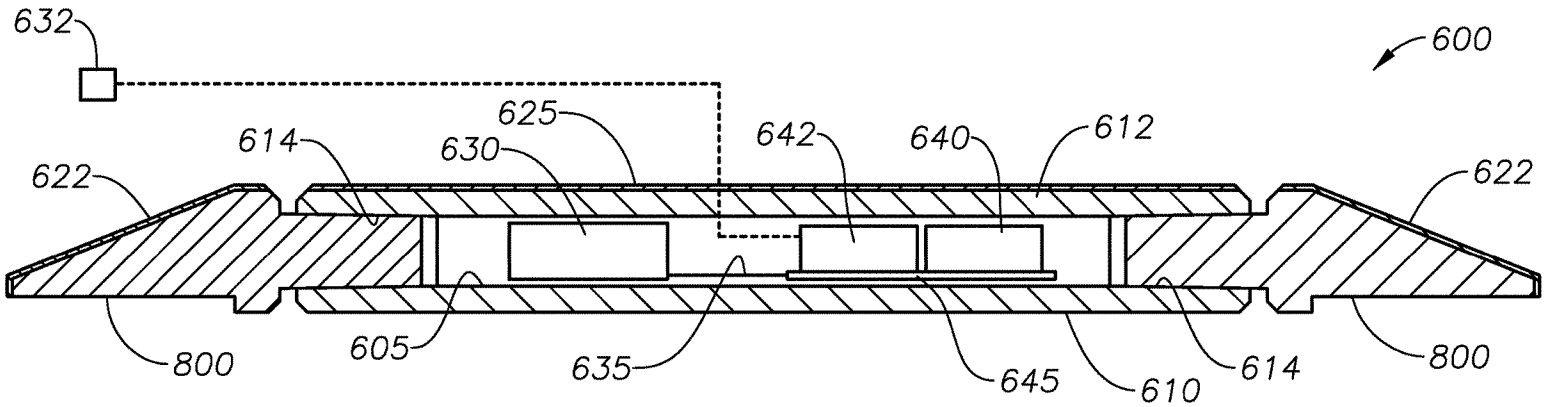
FIG. 6C is another cross-sectional view of the communications node of FIG. 6A, in an alternate embodiment. The view is again taken along the longitudinal axis of the node. Here, a sensor resides along the wellbore external to the communications node.

It is noted that in FIG. 6B, the sensor 632 resides within the housing 610 of the communications node 600. However, as noted, the sensor 632 may reside external to the communications node 600, such as above or below the node 600 along the wellbore 150. In FIG. 6C, a dashed line is provided showing an extended connection between an external sensor 632 and an electro-acoustic transducer 642.

In either arrangement, the sensor 632 may be, for example, (i) a pressure sensor, (ii) a temperature sensor, (iii) an induction log, (iv) a gamma ray log, (v) a formation density sensor, (vi) a sonic velocity sensor, (vii) a vibration sensor, (viii) a resistivity sensor, (ix) a flow meter, (x) a microphone, (xi) a geophone, (xii) a strain gauge, or (xiii) a combinations thereof. In one aspect, the transducer 642 is the sensor itself. This allows active acoustic response along a section of casing, thereby allowing the operator to evaluate cement integrity.

It is noted that the sensor communications node 600 need not, and preferably does not, have an acoustic transceiver 640; instead, part 640 of the communications node 600 is a transmitter (such as transmitter 554 shown schematically in FIG. 5). Thus, the transmitter 640 is placed within the bore 605 of the housing 610 for sending wireless signals to the logging tool 900.

Where the communications node 600 functions as an acoustic communications node 175 that is simply relaying acoustic signals up the wellbore, the communications node 600 need not have a transmitter. The only exception is for the last communications node in series, wherein the transducer 642 receives signals from the closest acoustic communications node 175 and stores those signals in memory until transmitted to the logging tool 900 using a transmitter.

Figure 7:
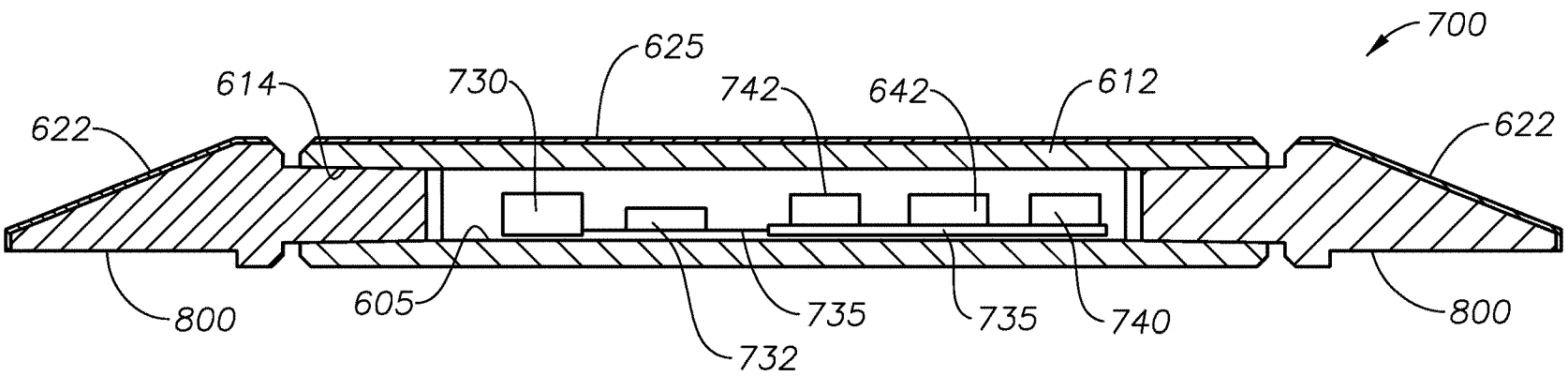
FIG. 7 is a cross-sectional view of a modified sensor communications node. The view is taken along the longitudinal axis of the node. A sensor is provided within the communications node. In addition, the sensor communications node includes a transmitter.

FIG. 7 provides a cross-sectional view of a communications node 700 as may be used for a last sensor communications node 170 of FIG. 2A. The housing 610, the bore 605, and other hardware components are generally constructed in accordance with the acoustic communications node 600 of FIG. 6A. In addition, a transducer 642 is shown for converting acoustic signals into electrical signals. However, a memory 742 is shown for storing signals received from the one or more acoustic communications nodes 175. These signals are multi-plexed so that a processor may correlate the signals with time and location within the wellbore. In addition, the sensor communications node 700 includes a transmitter 740.

As with communications node 600, communications node 700 will preferably have a battery 730, a power supply wire 735, and a circuit board 745. The circuit board 745 will preferably include a micro-processor or electronics module that processes signals from a sensor 732. The micro-processor may be associated with the memory 742.

The communications nodes 600, 700 optionally have a protective outer layer 625. The protective outer layer 625 resides external to the wall 612 and provides an additional thin layer of protection for the electronics. The communications nodes 600, 700 are also fluid-sealed within the housing 610 to protect the internal electronics. Additional protection for the internal electronics is available using an optional potting material.

The communications nodes 600, 700 also optionally each include shoes 800. More specifically, the nodes 600, 700 include pairs of shoes 800 disposed at opposing ends of the wall 612. Each of the shoes 800 provides a beveled face that helps prevent the node from hanging up on an external tubular body or the surrounding earth formation, as the case may be, during run-in or pull-out. The shoes 800 may have a protective outer layer 622 and an optional cushioning material 624 (shown in FIG. 6A) under the outer layer 622.

Figure 8A:
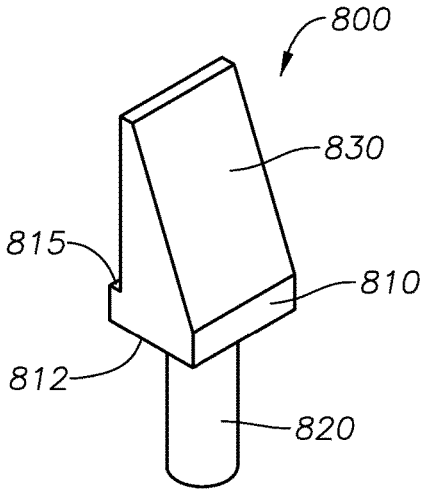
FIGS. 8A and 8B are perspective views of a shoe as may be used on opposing ends of the communications node of FIG. 6A or FIG. 7, in one embodiment.
Figure 8B:
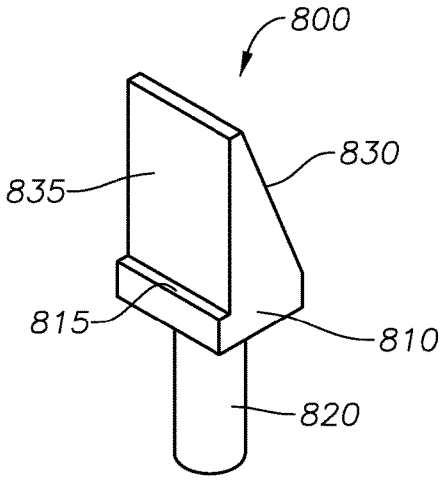

FIGS. 8A and 8B are perspective views of an illustrative shoe 800 as may be used on an end of either of the communications nodes 600, 700, in one embodiment. In FIG. 8A, the leading edge or front of the shoe 800 is seen, while in FIG. 8B the back of the shoe 800 is seen.

The shoe 800 first includes a body 810. The body 810 includes a flat under-surface 812 that butts up against opposing ends of the wall 612 of the communications node 600 or 700.

Extending from the under-surface 812 is a stem 820. The illustrative stem 820 is circular in profile. The stem 820 is dimensioned to be received within opposing recesses 814 of the wall 612 of the nodes 600, 700.

Extending in an opposing direction from the body 810 is a beveled surface 830. As noted, the beveled surface 830 is designed to prevent the communications node 600 or 700 from hanging up on an object during run-in into a wellbore.

Behind the beveled surface 830 is a flat surface 835. The flat surface 835 is configured to extend along the production casing 130 (or other tubular body) when the communications node 600 or 700 is attached to the tubular body 500. In one aspect, the shoe 800 includes an optional shoulder 815. The shoulder 815 creates a clearance between the flat surface 835 and the tubular body opposite the stem 820.

Referring again to FIG. 2A, three sensor communications nodes 170 and two acoustic communications nodes 175 are shown. Of course, any number of the respective nodes 170, 175 may be used. Indeed, all of the communications nodes may be sensor communications nodes 170.

It is observed that the use of acoustic communications nodes 170 is potentially problematic. This approach relies upon all acoustic communications nodes 170 in a series functioning properly in order to relay data up the wellbore 150. If one of the acoustic communications nodes 170 fails, data from the lower acoustic communications nodes is never relayed to a sensor communications node 170, and that data is never harvested. Therefore, it is preferred that sensor communications nodes 175 be used in areas where acoustic continuity is unreliable, such as near a sliding sleeve or along perforations.

In the arrangement of FIG. 2A, a sensor communications node 170 is shown at the top, followed by two acoustic communications nodes 175 that send signals up the casing 130 to the sensor communications node 170. More than two acoustic communications nodes 175 may be placed there. Additionally, two sensor communications nodes 170 are placed along the wellbore 150 in between perforations 159.

Each communications node receives signals from a corresponding sensor (shown at 632 in FIG. 6B and at 732 in FIG. 7). In the case of a sensor communications node 170, the signal is a direct electrical signal. In the case of an acoustic communications nodes 175, those signals are converted to acoustic signals, and then transmitted through the pipe to a next acoustic communications node 175. Such acoustic waves are preferably at a frequency of between about 50 kHz and 500 kHz. More preferably, the acoustic wave are transmitted at a frequency of between about 100 kHz and 125 kHz. Those acoustic signals may be digitized by the micro-processor.

In one preferred embodiment, the acoustic telemetry data transfer is accomplished using multiple frequency shift keying (MFSK). Any extraneous noise in the signal is moderated by using known analog and/or digital signal processing methods. This noise removal and signal enhancement may involve conveying the acoustic signal through a signal conditioning circuit using, for example, a bandpass filter.

The transceiver in the acoustic communications nodes 175 will also produce acoustic telemetry signals. In one preferred embodiment, an electrical signal is delivered to an electromechanical transducer, such as through a driver circuit. In a preferred embodiment, the transducer is the same electro-acoustic transducer that originally received the MFSK data. The signal generated by the electro-acoustic transducer then passes through the housing 610 to the tubular body, that is, the liner 130, and propagates along the tubular body to a next acoustic communication nodes 175. In one aspect, the acoustic signal is generated and received by a magnetostrictive transducer comprising a coil wrapped around a core as the transceiver. In another aspect, the acoustic signal is generated and received by a piezo-electric ceramic transducer. In either case, the filtered signal is delivered up to a sensor communications node 170.

In FIG. 2A, communications nodes 170, 175 are shown along Section 2A of the wellbore 150 of FIG. 1. This section is located along the subsurface formation 155, or pay zone. However, communications nodes 170 may also be placed in sections of the wellbore that are above the pay zone.

FIG. 2B is another enlarged side, cross-sectional view of a portion of the wellbore 150 of FIG. 1. Here, a portion 2B of the wellbore 150 is shown. The portion is generally shown above the subsurface formation 155.

In FIG. 2B, two sensor communications nodes 170 are shown placed along an outer surface of the production casing 130. In addition, a series of sensor communications nodes 170 is placed along an outer surface of the production tubing 140. The sensor communications nodes 170 that reside along the production tubing 140 include sensors (shown at 732 in FIG. 7) for collecting data indicative of a subsurface condition. Such a condition may be, for example, annular pressure, annular temperature, or the presence of noise suggesting that fluid is flowing above the packer 142. The sensors 170 in FIG. 2B are independently powered, such as through the use of batteries 730.

Figure 2C:
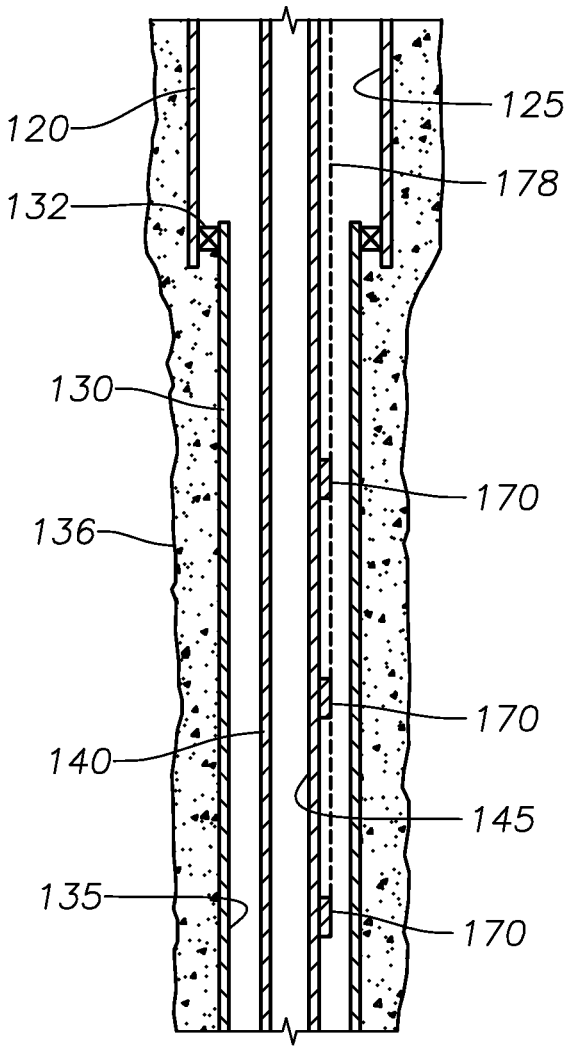
FIG. 2C is an enlarged side, cross-sectional view of a portion of the wellbore of FIG. 1. Here, portion 2C from the wellbore of FIG. 1 is shown. Communications nodes are shown along the production tubing.

In an alternate arrangement, the sensors 170 along the production tubing 140 may be powered via a power cable. FIG. 2C is another enlarged side, cross-sectional view of a portion of the wellbore 150 of FIG. 1. Here, a portion 2C of the wellbore 150 is shown. Portion 2C shows sensor communications nodes 170 spaced along the production tubing 140. An insulated electric power cable 178 is shown extending down to the nodes 170 to provide electrical power to components.

The sensor communications nodes 170 gather data from the sensors 732 and store them in memory 742. The data remains in memory 742 until it is harvested by the logging tool 900.

Figure 9:
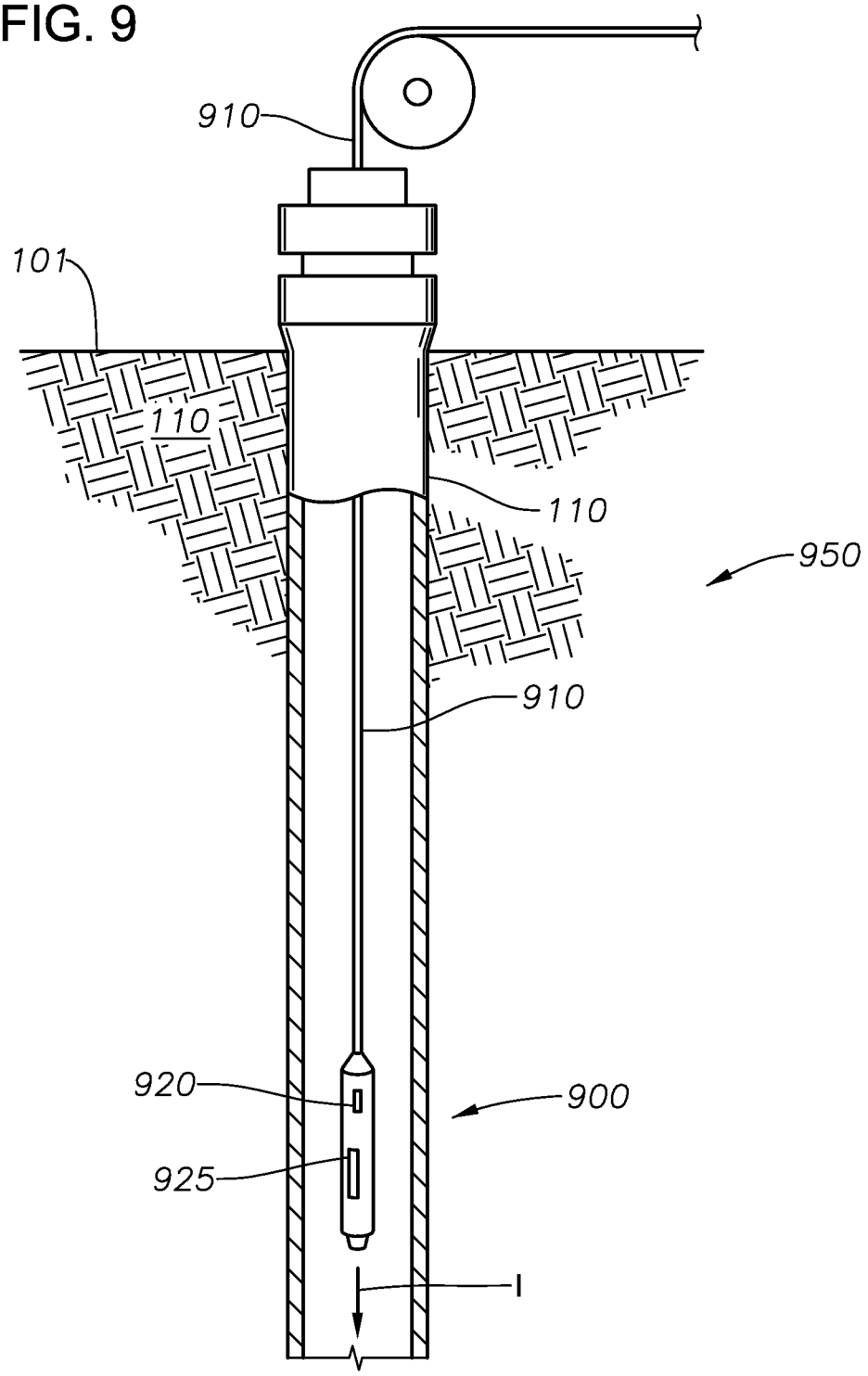
FIG. 9 is a cross-sectional view of an upper portion of a wellbore. Here, a logging tool is being run into the wellbore at the end of a working line. The logging tool is used to harvest data transmitted by sensor communications nodes within a wellbore.

FIG. 9 is a cross-sectional view of an upper portion of a wellbore 950. Here, the logging tool 900 is seen being run into the wellbore 950 according to arrow "I." The logging tool 900 is placed proximate the end of a working line 910. The working line 910 may be a "dumb" working line such as a slick line or coiled tubing. Alternatively, the working line 910 may provide electrical or optical communication with a processor at the surface 101. Such a processor is shown at 190 in FIG. 1.

The logging tool 900 is used to harvest data transmitted by sensor communications nodes 170 within the wellbore 950. To this end, the logging tool 900 includes a receiver 920. The receiver 920 wirelessly picks up transmissions from the transmitters 740 in the sensor communications nodes 700. Data transmission may be by means of any wireless protocol, including Wi-Fi or BlueTooth.

The harvested signals are delivered to the surface 101. In one aspect, signals are sent up the working line 910 using electrical or optical communication. In another aspect, the logging tool 900 is spooled back to the surface 101 and data is then uploaded from the logging tool 900 to the processor 190. In this instance, the logging tool 900 will preferably be powered by batteries, shown schematically at 925.

The processor 190 comprises a computer 192 with memory that processes the signals sent from the receiver 920. The processor 192 may be incorporated into a computer having a screen and a separate keyboard 194, as is typical for a desk-top computer. Alternatively, the computer 192 has an integral keyboard as is typical for a laptop or a personal digital assistant. In one aspect, the processor 190 is part of a multi-purpose "smart phone" having specific software applications, or "apps," and wireless connectivity.

In one arrangement, the communications nodes (such as nodes 600 with the shoes 800) are welded onto an inner or outer surface of the tubular body, such as wall 310 of the pipe joint 300. More specifically, the body 610 of the respective communications nodes 600 are welded onto the wall of the tubular body. In some cases, it may not be feasible or desirable to pre-weld the communications nodes 600 onto pipe joints before delivery to a well site. Further still, welding may degrade the tubular integrity or damage electronics in the housing 610. Therefore, it is desirable to utilize a clamping system that allows a drilling or service company to mechanically connect/disconnect the communications nodes 600 along a tubular body as the tubular body is being run into a wellbore.

In the illustrative arrangements of FIGS. 2A through 2C, the communications nodes 170, 175 are secured to an outer surface of a tubular body in a wellbore. In one aspect, the securing is by means of at least one clamp.

Figure 10:
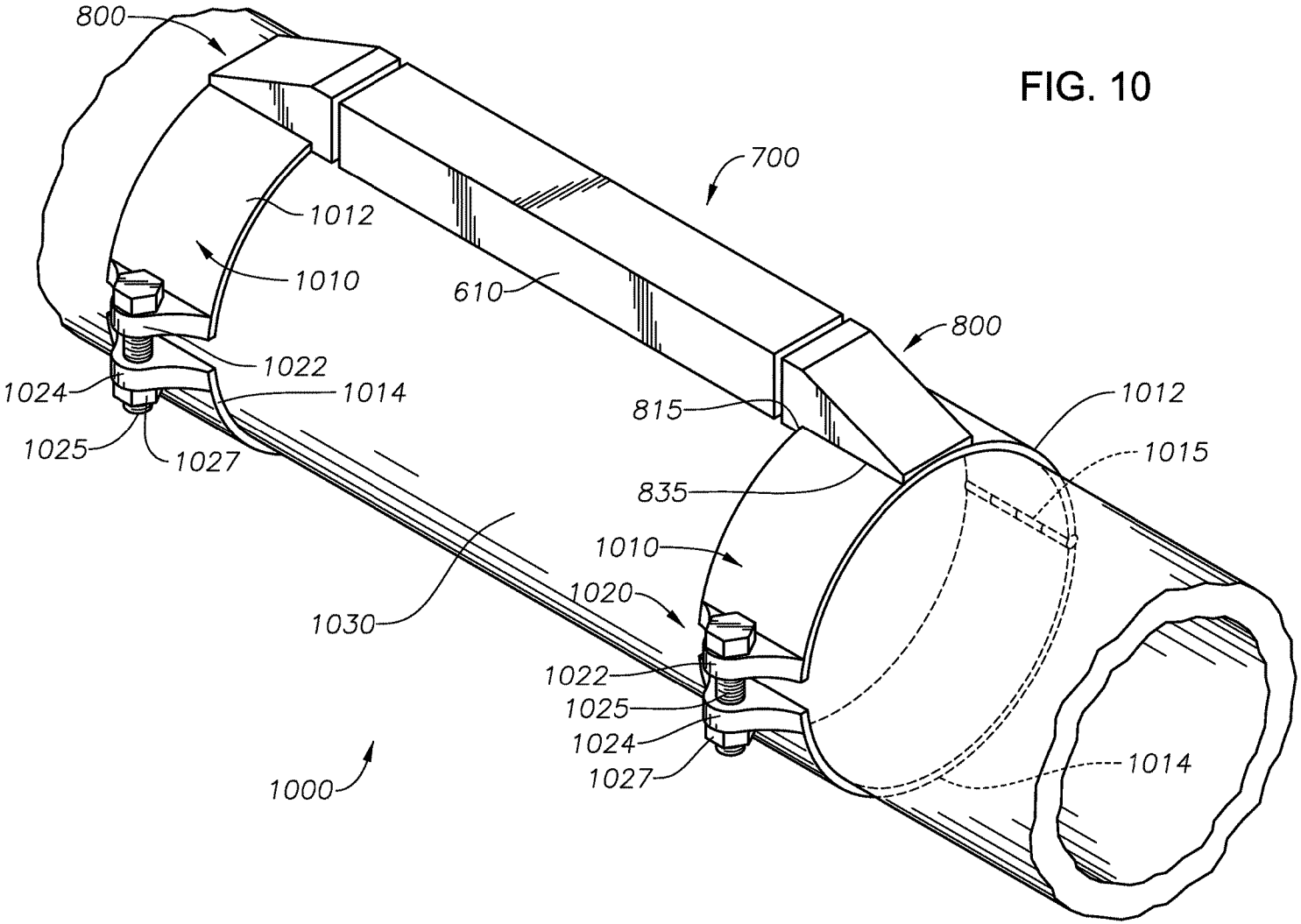
FIG. 10 is a perspective view of a portion of a communications node system of the present invention, in one embodiment. The illustrative communications node system utilizes a pair of clamps for connecting a communications node (such as either of the communications nodes of FIG. 6A or FIG. 7) onto a tubular body.

FIG. 10 is a perspective view of a portion of a communications node system 1000 of the present invention, in one embodiment. The communications node system 1000 utilizes a pair of clamps 1010 for mechanically connecting a communications node 700 onto a tubular body 1030.

The system 1000 first includes at least one clamp 1010. In the arrangement of FIG. 10, a pair of clamps 1010 is used. Each clamp 1010 abuts the shoulder 815 of a respective shoe 800. Further, each clamp 1010 receives the base 835 of a shoe 800. In this arrangement, the base 835 of each shoe 800 is welded onto an outer surface of the clamp 1010. In this way, the clamps 1010 and the communications node 700 become an integral tool.

The illustrative clamps 1010 of FIG. 10 include two arcuate sections 1012, 1014. The two sections 1012, 1014 pivot relative to one another by means of a hinge. Hinges are shown in phantom at 1015. In this way, the clamps 1010 may be selectively opened and closed.

Each clamp 1010 also includes a fastening mechanism 1020. The fastening mechanisms 1020 may be any means used for mechanically securing a ring onto a tubular body, such as a hook or a threaded connector. In the arrangement of FIG. 10, the fastening mechanism is a threaded bolt 1025.

The bolt 1025 is received through a pair of rings 1022, 1024. The first ring 1022 resides at an end of the first section 1012 of the clamp 1010, while the second ring 1024 resides at an end of the second section 1014 of the clamp 1010. The threaded bolt 1025 may be tightened by using, for example, one or more washers (not shown) and threaded nuts 1027.

In operation, a clamp 1010 is placed onto the tubular body 1030 by pivoting the first 1012 and second 1014 arcuate sections of the clamp 1010 into an open position. The first 1012 and second 1014 sections are then closed around the tubular body 1030, and the bolt 1025 is run through the first 1022 and second 1024 receiving rings. The bolt 1025 is then turned relative to the nut 1027 in order to tighten the clamp 1010 and connected communications node 700 onto the outer surface of the tubular body 1030. Where two clamps 1010 are used, this process is repeated.

The tubular body 1030 may be, for example, a string of casing, such as the casing string 130 of FIG. 1. The wall 612 of the communications node 700 is ideally fabricated from a steel material having a resonance frequency compatible with the resonance frequency of the tubular body 1030. In addition, the mechanical resonance of the wall 612 is at a frequency contained within the frequency band used for telemetry.

In one aspect, the communications node 700 is about 12 to 16 inches (0.30 to 0.41 meters) in length as it resides along the tubular body 1030. Specifically, the housing 610 of the communications node 700 may be (0.20 to 0.25 meters) in length, and each opposing shoe 800 may be 2 to 5 inches (0.05 to 0.13 meters) in length. Further, the communications node 700 may be about 1 inch in width and 1 inch in height. The housing 610 of the communications node 700 may have a concave profile that generally matches the radius of the tubular body 1030.

There are benefits to the use of an externally-placed communications node. For example, such a node will not interfere with the flow of fluids within the internal bore 515 of the pipe joint 500. Further, installation and mechanical attachment can be readily assessed or adjusted, as necessary. In the case of acoustic communications nodes 175, because the acoustic signals are carried by the wall 510 of the pipe joint 500 itself, the data is largely unaffected by the fluids in the pipe joint 500.

Figure 3:
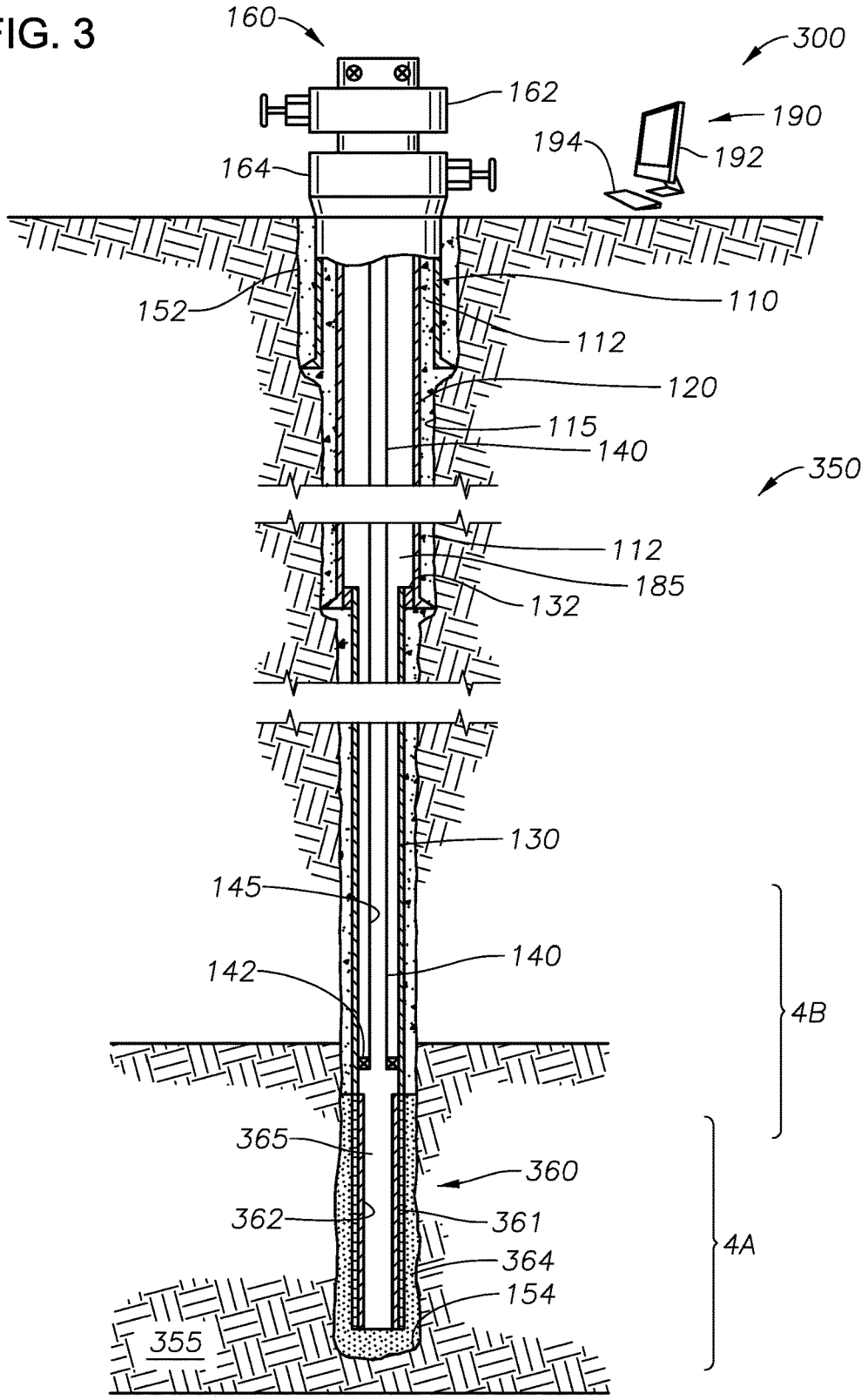
FIG. 3 is a side, cross-sectional view of another wellbore. The wellbore has been completed as an open-hole completion. A sand control screen is in place below the production tubing.

Returning again to FIG. 1, FIG. 1 shows a wellbore 150 having been completed as a cased hole completion. However, the downhole telemetry system described herein has equal utility with respect to open hole completions. FIG. 3 shows a wellbore 350 having been completed as an open hole completion.

The wellbore 350 of FIG. 3 is generally constructed in accordance with the wellbore 150 of FIG. 1. However, the wellbore 350 utilizes a sand control screen 360 that is placed below the production tubing 140. The sand control screen 360 is actually a series of screen joints made up of an external filtering medium 361 and an internal base pipe 362. A gravel pack 364 may optionally be installed around the sand control screen 160. Together, the gravel pack 364 and the filtering medium 361 prevent formation fines and sand particles from invading the wellbore 350. Production fluids move through the gravel pack 364, the filtering medium 361 and the slotted base pipe 362, and into the bore 365 of the sand control screen 360.

Figure 4B:
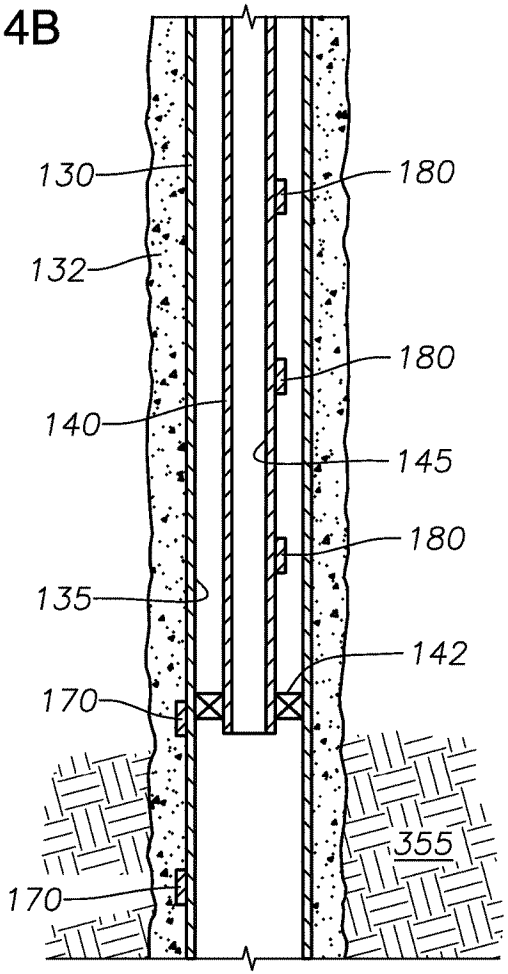
FIG. 4B is an enlarged side, cross-sectional view of a portion of the wellbore of FIG. 3. Here, portion 4B is shown.
Figure 4A:
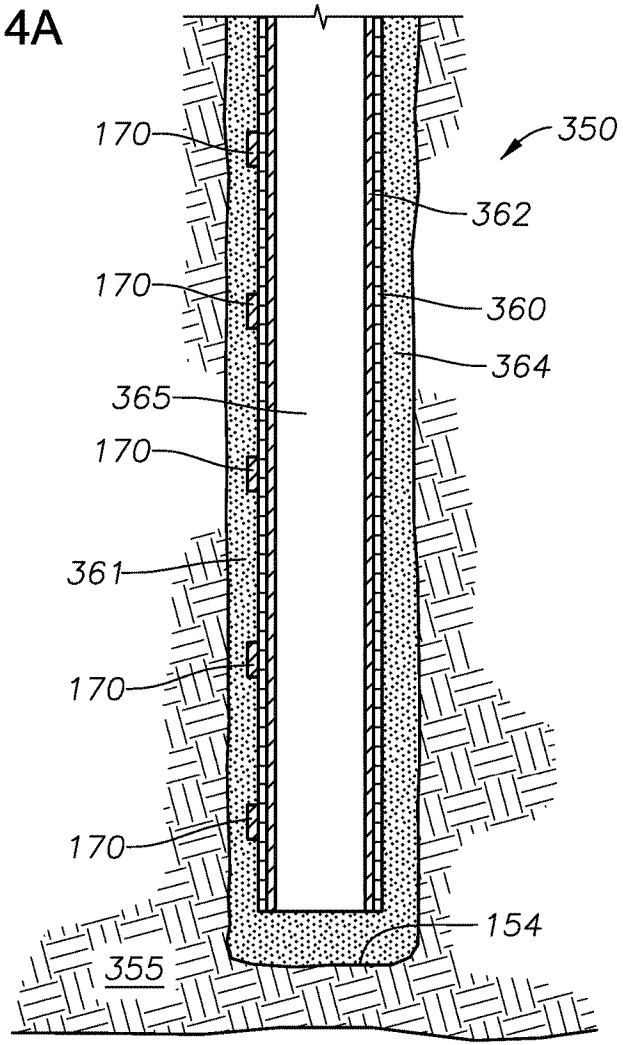
FIG. 4A is an enlarged side, cross-sectional view of a portion of the wellbore of FIG. 3. Here, portion 4A from the wellbore of FIG. 3 is shown. Communications nodes are shown along both the production casing and the production tubing.

FIG. 4A is an enlarged side, cross-sectional view of a portion of the wellbore 350 of FIG. 3. Here, portion 4A of the wellbore 350 of FIG. 3 is shown. In FIG. 4A, sensor communications nodes 170 have been placed around the sand control screen 360 along subsurface formation 355.

FIG. 4B is another enlarged side, cross-sectional view of a portion of the wellbore 350 of FIG. 3. Here, portion 4B is shown. In FIG. 4B, sensor communications nodes 170 have been placed around the sand control screen 360 and along a lower portion of the production tubing 140.

It is understood that the sensor communications nodes 170 may be placed on inner or outer surfaces of the base pipe 362. However, a benefit of the sensor communications nodes 170 is that they may be placed on an outer surface of the sand control screen joints as they do not rely upon the resonant pipe as the carrier medium for the acoustic transmission of data.

FIG. 3, together with FIGS. 4A and 4B, demonstrates the use of a downhole telemetry system that employs sensor communications nodes 170 and a logging tool 900 in a vertical, open-hole completion. However, the system has equal applicability to wellbores that are completed horizontally.

Figure 11:
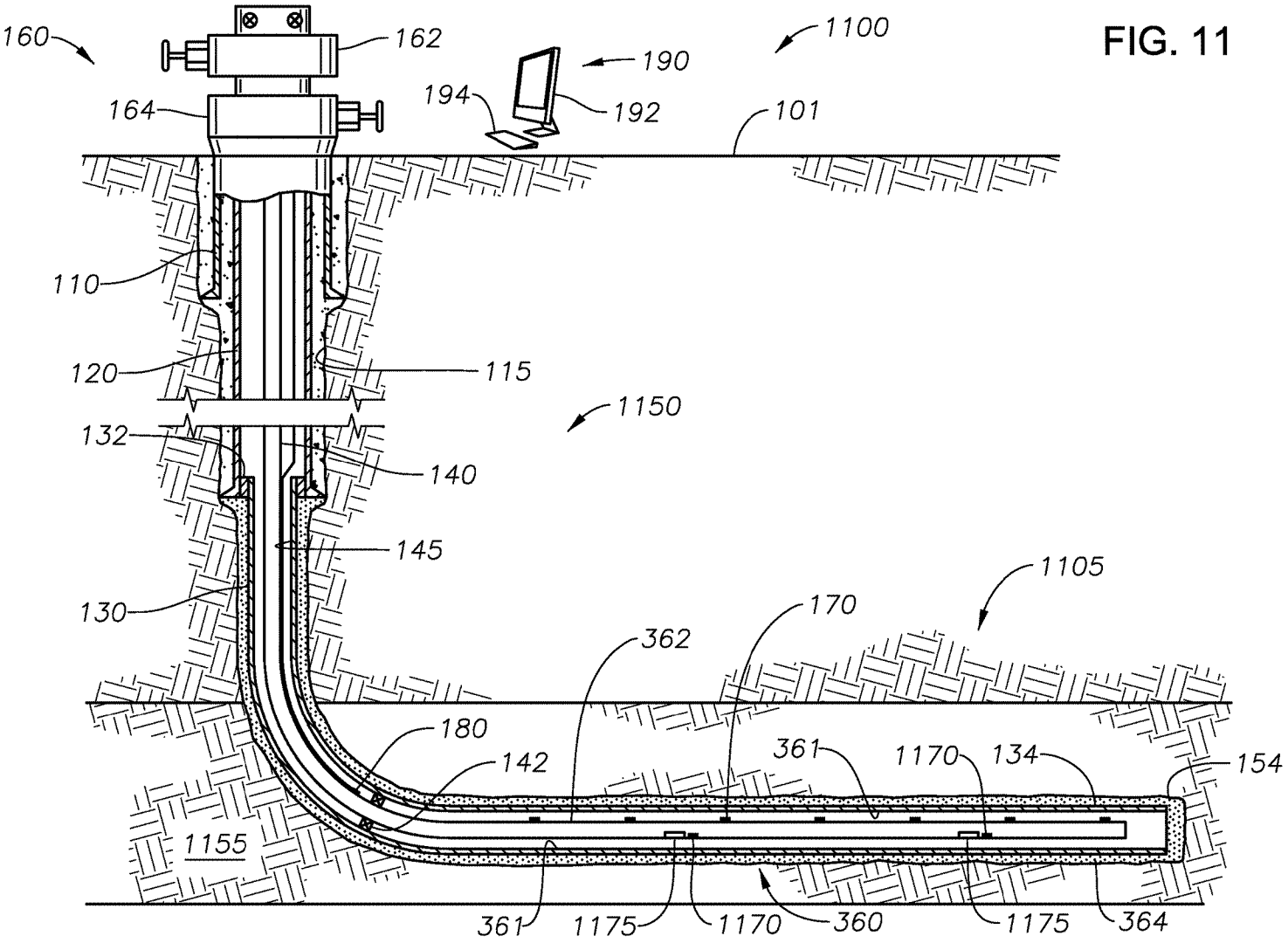
FIG. 11 is a cross-sectional view of a wellbore having been completed in an alternate manner. Here, the illustrative wellbore has been completed as an open hole completion, with a horizontal portion. A series of sensor communications nodes is placed along the base pipe of a sand control screen in the open hole completion as part of a telemetry system.

FIG. 11 is a cross-sectional view of a wellbore 1100 having been completed in an alternate manner. Here, the illustrative wellbore 1100 has been completed as an open hole completion, with a horizontal portion 1105. The horizontal portion 1105 resides along a subsurface formation 1155, or pay zone.

A sand control screen 360 has been placed along the subsurface formation 1105 in horizontal orientation. The sand control screen 360 extends below a packer 142. It is understood that the sand control screen 360 is actually a series of joints of screen, with each joint having a filter medium 361 (referred to as the "screen") wrapped or wound around a base pipe 162. The screen 361 serves as an external filtering medium.

The slotted base pipe 362 extends below the production tubing 140. The base pipe 362 is slotted to allow in ingress of filtered formation fluids into the wellbore 1150. The base pipe 362 resides within the joints of screen 361 and is in fluid communication with the production tubing 140.

It is preferred, though not required, to place a gravel slurry 364 around the screen 361 to support the surrounding formation 1155 and to provide further fluid filtering. This is known as a gravel pack. The use of sand control screens 360 with gravel packs 364 allows for greater fluid communication with the surrounding rock matrix while still providing support for the wellbore 1150.

Because the wellbore 1150 is completed as an open hole, the production casing 130 need not extend below the packer 142. No perforations or fractures are needed. Therefore, these aspects of the horizontal portion 1105 of the wellbore 1150 are not seen.

In the wellbore arrangement of FIG. 11, sensor communications nodes 170 reside along the slotted base pipe 362. The sensor communications nodes 170 use sensors that sense, for example, temperature and/or pressure along the sand control screen 360. The sensor communications nodes 170 record signals sent from the respective sensors until the data is retrieved by the logging tool 900.

Of interest, the wellbore 1150 of FIG. 11 includes an inflow control device 1175. The inflow control device 1175 may be a sliding sleeve or a restricted orifice. Sensor communications nodes 1170 may optionally be placed along one of the inflow-control devices 1175 to monitor fluid flow, fluid temperature, or other wellbore parameter. In one aspect, the communications node 1170 may be programed to close or to adjust an inflow control device 1175 when a wellbore parameter is sensed. For example, if rate of flow along an inflow control device 1175 appears too low, a signal may be sent from the communications node 1170 automatically to further open a sliding sleeve or orifice. Similarly, a signal may be sent to a sliding sleeve 1175, telling a sleeve to close further, or to completely close. This provides a "smart well" that controls an ingress of the production fluids along selected portions of the formation. This is particularly beneficial for wells having horizontal completions that extend many thousands of feet.

Beneficially, electrical or electro-magnetic energy may be sent from a logging tool 900 to re-energize batteries operating in the inflow control devices 1175 and associated communications nodes 1170. For the horizontally-completed wellbore 1150, the working line will be a string of coiled tubing.

FIGS. 1, 3 and 11 present illustrative wellbores 150, 350, 1150 having a downhole telemetry system that uses a series of sensor communications nodes having associated transmitters. The transmitters deliver wireless signals to a receiver in a logging tool. In each of FIGS. 1, 3 and 11, the top of the drawing page is intended to be toward the surface and the bottom of the drawing page toward the well bottom. While wells commonly are completed in substantially vertical orientation, it is understood that wells may also be inclined and even horizontally completed. When the descriptive terms "up" and "down" or "upper" and "lower" or similar terms are used in reference to a drawing, they are intended to indicate location on the drawing page, and not necessarily orientation in the ground, as the present inventions have utility no matter how the wellbore is orientated.

A method for transmitting data in a wellbore is also provided herein. The method preferably employs the communications node 700 of FIG. 7 and the clamps 1010 of FIG. 10.

Figure 12:
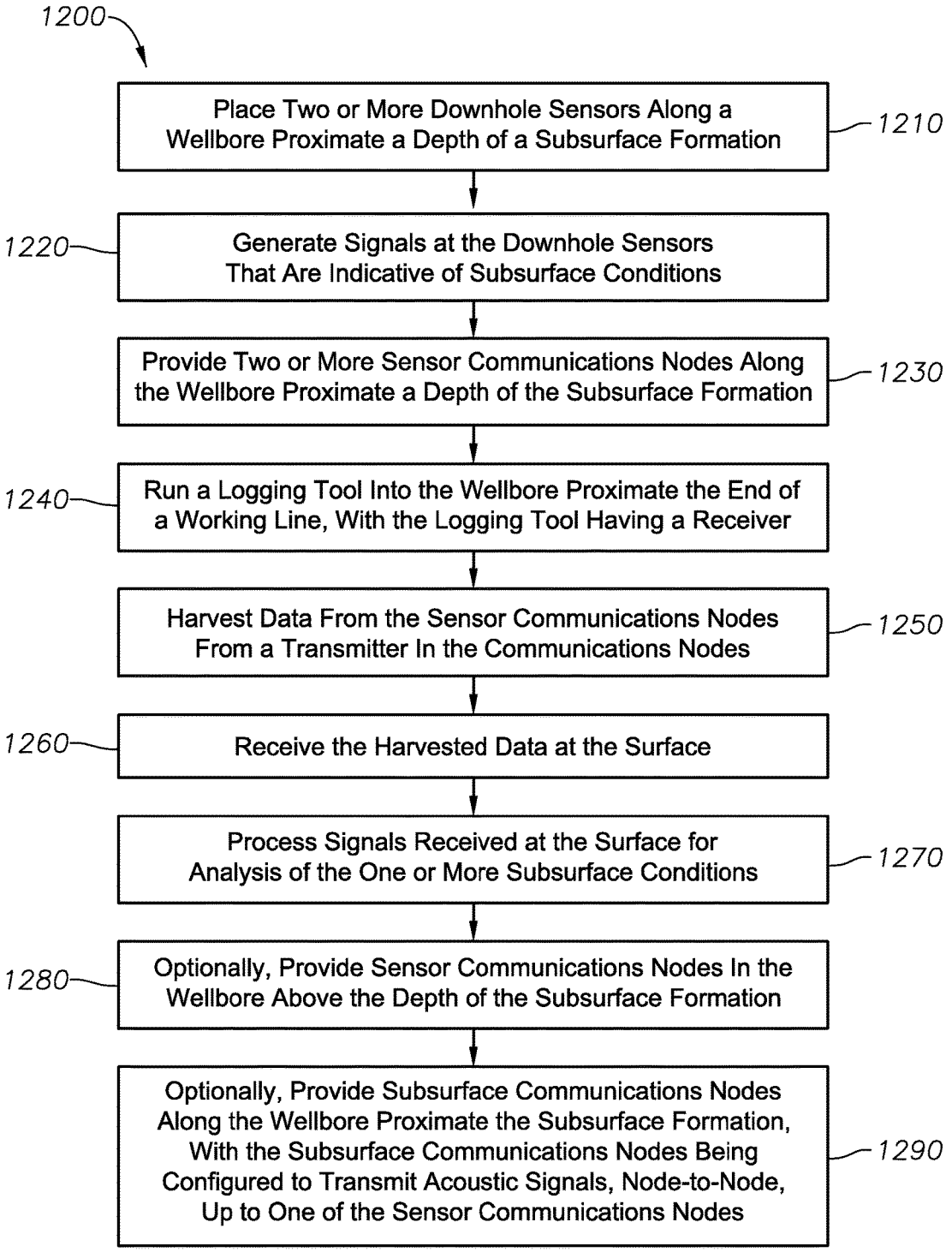
FIG. 12 is a flowchart demonstrating steps of a method for transmitting data in a wellbore in accordance with the present inventions, in one embodiment.

FIG. 12 provides a flow chart for a method 1200 of transmitting date in a wellbore. The method 1200 uses a plurality of communications nodes situated along a tubular body to accomplish a hybrid wired-and-wireless transmission of data along the wellbore. The wellbore penetrates into a subsurface formation, allowing for the communication of a wellbore condition at the depth of the subsurface formation up to the surface.

The method 1200 first includes placing one or more or, more preferably, two or more downhole sensors along the wellbore. This is shown at Box 1210. The sensors are placed proximate a depth of the subsurface formation. The sensors may be, for example, pressure sensors, temperature sensors, formation logging tools or casing strain gauges.

The method 1200 also includes generating signals at the downhole sensors. This is provided at Box 1220. The signals are indicative of subsurface conditions.

The method 1200 further includes providing sensor communications nodes along the wellbore. This is indicated at Box 1230. The sensor communications nodes are also placed proximate a depth of the subsurface formation. Preferably, the sensors from step 1210 reside within a housing of an associated sensor communications node. Also, the sensor communications nodes are preferably clamped to an outer surface of a string of production casing.

The sensor communications nodes preferably reside on an outer diameter of a string of production casing. Alternatively or in addition, each of the sensor communications nodes reside on an outer diameter of a joint of production tubing. Alternatively or in addition, each of the sensor communications nodes resides on either an inner diameter or an outer diameter of joints of sand control screen, such as along the base pipe of sand control screen joints.

Each of the sensor communications nodes preferably has an independent power source. The independent power source may be, for example, batteries or a fuel cell. In addition, each of the sensor communications nodes has a transmitter. The transmitter is designed and configured to transmit wireless signals indicative of the subsurface condition or wellbore parameter being sensed by the sensors.

The method 1200 additionally includes running a logging tool into the wellbore. This is indicated at Box 1240. The logging tool includes a wireless receiver. The logging tool is positioned proximate the end of a working line. The working line may be, for example, a slick line, an insulated electric line, coiled tubing or a fiber optic cable.

The method 1200 also includes harvesting data from the sensor communications nodes. This is provided at Box 1250. As the logging tool passes across the sensor communications nodes, the receiver picks up the wireless signals from the transmitter.

The method 1200 further includes receiving the harvested downhole data at the surface. This is seen at Box 1260. In one embodiment, receiving the harvested data comprises transmitting the harvested data from the logging tool up a communications wire in the working line and to a processor at the surface. In this instance, the communications wire may be an insulated electrical cable or a fiber optic cable. In another embodiment, receiving the harvested data comprises storing the harvested data in memory on the logging tool, pulling the running tool from the wellbore, retrieving the logging tool, and then uploading the harvested data onto a processor at the surface.

In either instance, the method 1200 will also include processing the signals received at the surface. This is shown at Box 1270. The signals are processed for analysis of the subsurface conditions. Analysis may be by an operator, by software, or both.

Optionally, additional sensor communications nodes may be placed above the depth of the subsurface formation. This is seen at Box 1280. Optionally, separate acoustic communications nodes may be provided. This is seen at Box 1290. The acoustic communications nodes may be placed in series above an upper sensor communications node, or even between sensor communications nodes.

Each of the acoustic communications nodes has an electro-acoustic transceiver for sending and receive acoustic waves. Preferably, a frequency would be selected that is between about 100 kHz and 125 kHz to more closely match the anticipated resonance frequency of the pipe material itself.

The acoustic communications nodes are configured to transmit signals generated by one of the sensor communications nodes that is indicative of a subsurface conditions acoustically. In one aspect, piezo wafers or other piezoelectric elements are used to transmit the acoustic signals. In another aspect, multiple stacks of piezoelectric crystals or other magnetostrictive devices are used. Signals are created by applying electrical signals of a designated frequency across one or more piezoelectric crystals, causing them to vibrate at a rate corresponding to the frequency of the desired acoustic signal.

In one aspect, the data transmitted between the subsurface communications nodes is represented by acoustic waves according to a multiple frequency shift keying (MFSK) modulation method. Although MFSK is well-suited for this application, its use as an example is not intended to be limiting. It is known that various alternative forms of digital data modulation are available, for example, frequency shift keying (FSK), multi-frequency signaling (MF), phase shift keying (PSK), pulse position modulation (PPM), and on-off keying (OOK). In one embodiment, every 4 bits of data are represented by selecting one out of sixteen possible tones for broadcast.

Acoustic telemetry along tubulars is characterized by multi-path or reverberation which persists for a period of milliseconds. As a result, a transmitted tone of a few milliseconds duration determines the dominant received frequency for a time period of additional milliseconds. Preferably, the communication nodes determine the transmitted frequency by receiving or "listening to" the acoustic waves for a time period corresponding to the reverberation time, which is typically much longer than the transmission time. The tone duration should be long enough that the frequency spectrum of the tone burst has negligible energy at the frequencies of neighboring tones, and the listening time must be long enough for the multipath to become substantially reduced in amplitude. In one embodiment, the tone duration is 2 ms, then the transmitter remains silent for 48 milliseconds before sending the next tone. The receiver, however, listens for 2+48=50 ms to determine each transmitted frequency, utilizing the long reverberation time to make the frequency determination more certain. Beneficially, the energy required to transmit data is reduced by transmitting for a short period of time and exploiting the multi-path to extend the listening time during which the transmitted frequency may be detected.

In one embodiment, an MFSK modulation is employed where each tone is selected from an alphabet of 16 tones, so that it represents 4 bits of information. With a listening time of 50 ms, for example, the data rate is 80 bits per second.

The tones are selected to be within a frequency band where the signal is detectable above ambient and electronic noise at least two nodes away from the transmitter node so that if one node fails, it can be bypassed by transmitting data directly between its nearest neighbors above and below. In one example the tones are evenly spaced in period within a frequency band from about 50 kHz to 500 kHz.

In one aspect, the electro-acoustic transceivers in the acoustic communications nodes receive acoustic waves at a first frequency, and re-transmit the acoustic waves at a second different frequency. The electro-acoustic transceivers listen for the acoustic waves generated at the first frequency for a longer time than the time for which the acoustic waves were generated at the first frequency by a previous communications node. Ultimately, acoustic signals are sent up the wellbore and to another sensor communications node, that upper sensor communications node having a memory and a transmitter.

As can be seen, a novel downhole telemetry system is provided, as well as a novel method for the electro-acoustic transmission of information using a plurality of data transmission nodes.

As noted above, the downhole telemetry system may be used to adjust the flow of production fluids into a wellbore. Thus, a method for of activating a sliding sleeve in a wellbore is also provided herein.

While it will be apparent that the inventions herein described are well calculated to achieve the benefits and advantages set forth above, it will be appreciated that the inventions are susceptible to modification, variation and change without departing from the spirit thereof.

What is claimed is:

1. A method of transmitting data along a wellbore up to a surface, comprising:

placing one or more downhole sensors along the wellbore proximate a depth of a subsurface formation, the downhole sensors engaged with a tubular positioned within the wellbore, the tubular extending between the surface and the subsurface formation;

generating signals at the downhole sensors that are indicative of one or more subsurface conditions;

providing one or more sensor communications nodes along the tubular, each of the one or more sensor communications nodes including an acoustic transceiver in acoustic contact with the tubular for at least one of acoustically transmitting and acoustically receiving acoustic signals along the tubular;

configuring at least one of the sensor communications nodes to process the generated signals from a downhole sensor to an acoustic signal representing data pertaining to the one or more subsurface conditions;

acoustically transmitting the generated acoustic signals along the tubular via an acoustic transmitter using the tubular as the acoustic transmission carrier medium to another of the one or more sensor communications nodes at an acoustic frequency range of from about 50KHz to 500 KHz;

providing a memory in at least one of the sensor communications nodes to hold the acoustically transmitted data in the memory;

running a logging tool into the wellbore proximate the sensor communications mode comprising the provided memory, the logging tool having a logging tool acoustic receiver;

acoustically transmitting the data from the memory to the logging tool acoustic receiver to harvest the data; and receiving harvested data at the surface.

2. The method of claim 1, wherein the surface is an earth surface.

3. The method of claim 1, wherein the surface is a water surface.

4. The method of claim 1, wherein the sensors comprise at least one of (i) pressure sensors, (ii) temperature sensors, (iii) induction logs, (iv) gamma ray logs, (v) formation density sensors, (vi) sonic velocity sensors, (vii) vibration sensors, (viii) resistivity sensors, (ix) flow meters, (x) microphones, (xi) geophones, (xii) strain gauges, and (xiii) combinations thereof.

5. The method of claim 4, wherein receiving the harvested data comprises:

transmitting the harvested data from the logging tool along a communications wire in the working line and to a processor at the surface; and processing the data at the surface for analysis.

6. The method of claim 5, wherein the communications wire comprises at least one of an insulated electrical cable and a fiber optic cable.

7. The method of claim 4, wherein receiving the harvested data comprises:

storing the harvested data in memory on the logging tool;

pulling the working line from the wellbore;

retrieving the logging tool;

uploading the harvested data onto a processor at the surface; and processing the data for analysis.

8. The method of claim 4, wherein:

the one or more downhole sensors comprises at least two downhole sensors; and the one or more sensor communications nodes comprises at least two corresponding sensor communications nodes.

9. The method of claim 8, wherein the at least two sensor communications nodes reside on either an inner diameter or an outer diameter of a string of production casing.

10. The method of claim 9, wherein:

each of the at least two sensor communications nodes reside on an outer diameter of a joint of production casing; and each sensor communications node comprises a housing fabricated from a steel material.

11. The method of claim 10, wherein each sensor communications node further comprises at least one clamp for radially attaching the sensor communications node onto an outer surface of the production casing.

12. The method of claim 11, wherein the at least one clamp comprises:

a first arcuate section;

a second arcuate section;

a hinge for pivotally connecting the first and second arcuate sections; and a fastening mechanism for securing the first and second arcuate sections around an outer surface of the subsurface pipe.

13. The method of claim 4, wherein the one or more sensor communications nodes reside on either an inner diameter or an outer diameter of joints of sand control screen.

14. The method of claim 4, wherein the one or more sensor communications nodes reside on either an inner diameter or an outer diameter of a string of production tubing.

15. The method of claim 4, wherein:

the one or more downhole sensors comprises at least two downhole sensors;

the one or more sensor communications nodes comprises at least two corresponding sensor communications nodes;

each of the at least two sensor communications nodes resides on an outer diameter of a joint of production tubing; and each sensor communications node comprises a housing fabricated from a steel material.

16. The method of claim 15, wherein each sensor communications node further comprises at least one clamp for radially attaching the sensor communications node onto an outer surface of the production tubing.

17. The method of claim 15, wherein each of the two or more sensor communications nodes receives power from (i) a cable extending from the surface, or (ii) one or more batteries residing within the housing.

18. The method of claim 4, wherein positioning the tubular within the wellbore further comprises:

running joints of steel pipe into the wellbore, the joints of pipe being connected by threaded couplings to form a pipe string;

attaching a series of acoustic communications nodes to the joints of pipe according to a pre-designated spacing, wherein adjacent acoustic communications nodes are configured to communicate by acoustic signals transmitted through the joints of pipe, and wherein each of the acoustic communications nodes comprises:

a housing having a sealed bore;

an electro-acoustic transducer and associated transceiver residing within the housing configured to relay signals, with each signal representing a packet of information that comprises an identifier for a sensor communications node originally transmitting the signal, and an acoustic waveform indicative of a subsurface condition; and an independent power source also residing within the housing for providing power to the transceiver, and with the housing being fabricated from a material having a resonance frequency that is within the frequency band used for the acoustic signals;

sending acoustic signals from the acoustic communications nodes, node-to-node, to an upper sensor communications nodes having memory and an acoustic transmitter; and harvesting sensor data from the upper sensor communications node memory to the logging tool by acoustically transmitting the generated signals from the acoustic transmitter to the acoustic receiver.

19. The method of claim 18, wherein the pipe string is a section of production casing.

20. The method of claim 18, wherein at least one of the one or more downhole sensors resides within the housing of a corresponding sensor communications node.

21. The method of claim 18, wherein:

each of the acoustic communications nodes further comprises at least one clamp for radially attaching the communications node onto an outer surface of a subsurface pipe;

the subsurface pipe represents a joint of casing, a joint of liner, or a base pipe of a joint of sand control screen; and the step of providing one or more acoustic communications nodes along the wellbore comprises clamping the communications nodes to an outer surface of the subsurface pipe.

22. The method of claim 4, further comprising:

transmitting energy from the logging tool to the sensor communications nodes to recharge a battery within the sensor communications nodes.

23. A downhole acoustic telemetry system, comprising:

a tubular positioned within a wellbore, the tubular extending between a surface and a subsurface formation;

one or more downhole sensors residing along a wellbore proximate a depth of a subsurface formation, with each of the downhole sensors being configured to sense a subsurface condition and then send a signal indicative of the sensed subsurface condition;

one or more sensor communications nodes also residing along the tubular proximate a depth of the subsurface formation, at least one of the one or more sensor communications nodes configured to receive the signal from at least one of the one or more downhole sensors and process the received signal into an acoustic data signal pertaining to the one or more subsurface conditions, each of the one or more downhole sensor communications nodes comprising:

a housing having a sealed bore; and an acoustic transceiver residing with the sealed bore for at least one of receiving and transmitting wireless acoustic signals indicative of the subsurface condition to another of the one or more downhole sensor communications nodes using the tubular as an acoustic signal transmission medium between the nodes, each acoustic transceiver in acoustic contact with the tubular for at least one of (i) acoustically transmitting the acoustic data signals along the tubular and (ii) acoustically receiving the acoustic data acoustic signals from the tubular, at a frequency range of from about 50KHz to 500 KHz;

at least one of the one or more sensor communications nodes configured with a memory to hold data related to the acoustic data signals pertaining to the sensed subsurface condition, the memory provided within an upper of the one or more sensor communications nodes;

a logging tool having a logging tool acoustic receiver configured to acoustically harvest the data from the memory;

at least one of the one or more sensor communications nodes configured to acoustically transmit the acoustic data from the memory to the logging tool; and a working line configured to run the logging tool into a wellbore proximate an end of the working line to acoustically harvest the data from the memory and electronically convey the data to the surface.

24. The acoustic telemetry system of claim 23, wherein the sensors are (i) pressure sensors, (ii) temperature sensors, (iii) induction logs, (iv) gamma ray logs, (v) formation density sensors, (vi) sonic velocity sensors, (vii) vibration sensors, (viii) resistivity sensors, (ix) flow meters, (x) microphones, (xi) geophones, (xii) strain gauges, or (xiii) combinations thereof.

25. The acoustic telemetry system of claim 23, wherein at least one of the downhole sensors resides within the housing of a corresponding sensor communications node.

26. The acoustic telemetry system of claim 23, wherein at least one of the downhole sensors resides adjacent the housing of a corresponding sensor communications node.

27. The acoustic telemetry system of claim 23, wherein the logging tool further comprises a memory for storing the harvested data until the logging tool is retrieved back to the surface.

28. The acoustic telemetry system of claim 23, wherein the working line comprises an insulated electric cable or a fiber optic cable for transmitting harvested data to the surface in real time.

29. The acoustic telemetry system of claim 23, wherein the one or more sensor communications nodes reside on either an inner diameter or an outer diameter of a string of production casing within the wellbore.

30. The acoustic telemetry system of claim 23, wherein:

the one or more downhole sensors comprises at least two downhole sensors;

the one or more sensor communications nodes comprises at least two corresponding sensor communications nodes;

each of the sensor communications nodes reside on an outer diameter of a joint of production casing within the wellbore; and each sensor communications node comprises at least one clamp for radially attaching the sensor communications node onto an outer surface of the production casing.

31. The acoustic telemetry system of claim 30, wherein the at least one clamp comprises:

a first arcuate section;

a second arcuate section;

a hinge for pivotally connecting the first and second arcuate sections; and a fastening mechanism for securing the first and second arcuate sections around an outer surface of the subsurface pipe.

32. The acoustic telemetry system of claim 31, wherein:

each of the acoustic communications nodes further comprises a first shoe at the first end of the housing and a second shoe at the second end of the housing;

the first shoe and the second shoe each comprises:

a beveled edge designed to face away from the tubular body, a flat surface designed to face towards the tubular body, and a shoulder providing a clearance between the flat surface and the tubular body configured to receive a clamp.

33. The acoustic telemetry system of claim 23, wherein the one or more sensor communications nodes reside along either an inner diameter or an outer diameter of joints of sand control screen.

34. The acoustic telemetry system of claim 23, wherein the one or more sensor communications nodes reside on either an inner diameter or an outer diameter of a string of production tubing within the wellbore.

35. The acoustic telemetry system of claim 23, wherein:

the one or more downhole sensors comprises at least two downhole sensors;

the one or more sensor communications nodes comprises at least two corresponding sensor communications nodes;

each of the sensor communications nodes reside on an outer diameter of a joint of production tubing within the wellbore; and each sensor communications node comprises at least one clamp for radially attaching the sensor communications node onto an outer surface of the production tubing.

36. The acoustic telemetry system of claim 35, further comprising:

a power cable extending from the surface to provide power to the two or more sensor communications nodes.

37. The acoustic telemetry system of claim 23, wherein the joints of pipe form a section of production casing.

38. The acoustic telemetry system of claim 37, wherein:

each of the acoustic communications nodes further comprises at least one clamp; and each of the two or more acoustic communications nodes is clamped onto an outer surface of the production casing.

39. The acoustic telemetry system of claim 23, wherein at least one of the sensor communications nodes resides within or is in contact with a rock matrix making up the surface formation.

40. The acoustic telemetry system of claim 23, wherein at least one of the sensor communications nodes resides along a downhole tool.

41. The acoustic telemetry system of claim 40, wherein the downhole tool is a sliding sleeve or an inflow control device.

42. The acoustic telemetry system of claim 41, wherein the logging tool is configured to acoustically transmit an instruction to adjust the position of the downhole tool.

* * * * *